US011440096B2

(12) United States Patent
Brodskyy et al.

(10) Patent No.: US 11,440,096 B2
(45) Date of Patent: Sep. 13, 2022

(54) METHOD FOR PRODUCING ALLOY POWDERS BASED ON TITANIUM METAL

(71) Applicants: Velta Holdings US Inc., Wilmington, DE (US); RD Titan Group, TOV, Solonka (UA)

(72) Inventors: Andriy Brodskyy, Dnipro (UA); Viktor Troshchylo, Dnipro (UA); Andrii Gonchar, Solonka (UA); Oleksandr Chukhmanov, Zaporizhia (UA); Roman Romanov, Kamianske (UA)

(73) Assignees: Velta Holdings US Inc., Claymont, DE (US); RD Titan Group, TOV, Solonka (UA)

( * ) Notice: Subject to any disclaimer, the term of this patent is extended or adjusted under 35 U.S.C. 154(b) by 46 days.

(21) Appl. No.: 17/005,986

(22) Filed: Aug. 28, 2020

(65) Prior Publication Data

US 2022/0062993 A1 Mar. 3, 2022

(51) Int. Cl.

| | |
|---|---|
| ***B22F 9/24*** | (2006.01) |
| ***B22F 1/142*** | (2022.01) |
| ***C22C 1/04*** | (2006.01) |
| *B22F 9/04* | (2006.01) |

(52) U.S. Cl.

CPC ..... *B22F 9/24* (2013.01); *B22F 1/142* (2022.01); *C22C 1/0458* (2013.01); *B22F 2009/043* (2013.01); *B22F 2301/205* (2013.01); *B22F 2304/15* (2013.01)

(58) Field of Classification Search

None

See application file for complete search history.

(56) References Cited

U.S. PATENT DOCUMENTS

| | | | | |
|---|---|---|---|---|
| 4,373,947 | A | 2/1983 | Büttner et al. | |
| 9,283,622 | B2 | 3/2016 | Karaca et al. | |
| 9,567,690 | B2 | 2/2017 | Van Vuuren et al. | |
| 10,316,391 | B2 | 6/2019 | Abayaweera et al. | |
| 2010/0111817 | A1* | 5/2010 | Taniguchi | A61L 9/18 423/472 |
| 2011/0033371 | A1* | 2/2011 | Lu | B01J 35/1038 423/610 |
| 2013/0040129 | A1* | 2/2013 | Jin | C01G 45/02 428/328 |
| 2016/0108497 | A1 | 4/2016 | Fang et al. | |
| 2019/0283139 | A1 | 9/2019 | Zhang et al. | |

* cited by examiner

*Primary Examiner* — George Wyszomierski

(74) *Attorney, Agent, or Firm* — Warner Norcross + Judd LLP

(57) ABSTRACT

The invention relates to powder metallurgy, in particular to a method for metallothermal reduction of feedstock elements made from feedstock being a solid solution of oxides of various elements in titanium oxide, using magnesium and/or calcium as reducing agents. Processes include hydrolysis of an aqueous solution of a titanium-containing salt to obtain primary particles of crystalline titanium oxide, calcination of a precipitate of titanium oxides/hydroxides, formation of feedstock elements from a milled powder of a solid solution of dopants in titanium oxide, reduction of feedstock elements in one step using calcium metal or reduction of feedstock elements in two steps, using magnesium metal or calcium metal in the first step, and calcium metal in the second step. The aim of the invention is to produce alloy powders of titanium metal with a particularly low oxygen content.

38 Claims, 6 Drawing Sheets

METHOD FOR PRODUCING ALLOY POWDERS BASED ON TITANIUM METAL

FIELD OF INVENTION

The invention relates to powder metallurgy, in particular to a method for metallothermal reduction of feedstock elements made from feedstock being a solid solution of oxides of various elements in titanium oxide, using magnesium and/or calcium as reducing agents. Alloy powders based on titanium metal and/or powders of pure titanium metal produced according to the invention are used in various powder metallurgy techniques, additive technologies and other possible applications.

BACKGROUND TO THE INVENETION

International Patent Application WO2018/214849 (Publication Date: Nov. 29, 2018) describes a method that involves mixing of the dried titanium dioxide powder with magnesium powder to a uniform state, addition of the powder to a self-propagating reaction furnace in order to initiate self-propagating reactions. After obtaining an intermediate product of low-valence titanium oxide $Ti_XO$ dispersed in the MgO matrix, the intermediate product is leached with hydrochloric acid as a washing solution, followed by filtration, washing and vacuum drying. A precursor of low-valence titanium oxide $Ti_XO$ is obtained, which is uniformly mixed with calcium powder, subjected to pressing and placed into a vacuum reduction furnace for secondary deep reduction. The disadvantage of the known process is the duration of producing powders due to additional operations, such as: obtaining an intermediate product of low-valence titanium oxide $Ti_XO$, carrying out primary and secondary leaching.

U.S. Pat. No. 9,283,622B2 (Priority Date: Feb. 28, 2008) describes a method for producing alloy powders based on an element of Group 4 of the Periodic Table selected from titanium (Ti), zirconium (Zr) and hafnium (Hf) alloyed with nickel (Ni), copper (Cu), tantalum (Ta), tungsten (W), rhenium (Re), osmium (Os), or iridium (Ir), in which a powder of the base element oxide having an average grain size of 0.5 to 20 μm, a specific surface area according to BET of 0.5-20 $m^2/g$ and a minimum oxide content of 94 wet. %. is mixed with a metal powder of an alloying metal and a reducing agent powder, and this mixture is heated in a oven under an argon atmosphere until the reduction reaction begins, the reaction product is leached and then washed and dried. In the method, the alloying metal powder has a grain size of 0.5 to 15 μm. The powders produced by this method have a high oxygen content.

U.S. Pat. No. 4,373,947A (Priority Date: May 9, 1980) discloses a process for the preparation of alloy powders, which can be sintered and which are based on titanium, by calciothermal reduction of oxides of metals forming alloys in the presence of neutral additives. This can be accomplished by mixing $TiO_2$ with oxides of other alloy components, admixing an alkaline earth oxide or carbonate with metal oxides, and calcining the mixture. After cooling, the mixture is crushed and calcium is added. Thereafter, green compacts are formed which are heated and leached to remove calcium oxide. The resulting powder contains a high content of impurities, has high brittleness and strength, which does not allow its use in the production of titanium alloys used in all industries.

International Patent Application US20160108497 (Priority Date: Aug. 19, 2013) discloses a method for producing a titanium product. The method can include producing titanium slag ($TiO_2$) and reducing impurities in titanium slag to form purified $TiO_2$. The method can also include reducing the purified $TiO_2$ using a metallic reducing agent to form a hydrogenated titanium product containing $TiH_2$. The hydrogenated titanium product can be dehydrogenated to form a titanium product. The titanium product can be optionally deoxygenated to reduce oxygen content. When using the known method, it is possible to reduce the oxygen content to 0.2%.

U.S. Pat. No. 9,567,690B2 (Priority Date: Jun. 6, 2012) discloses a method for producing crystalline titanium powder containing single crystals or agglomerates of single crystals having an average crystal size (by volume) greater than 1 μm, said process including reacting a titanium chloride species and a reducing metal in molten chloride salt in a continuous back-mix reactor to produce a free flowing suspension of titanium powder in molten chloride salt. In the method both the titanium chloride species and the reducing metal are dissolved in a molten chloride salt containing seed crystals in the form of suspended titanium powder, and fed to said reactor containing a chloride salt of the reducing metal; the average feed ratio of the titanium chloride species and reducing metal fed to the continuous back-mix reactor is within 1% of the stoichiometric ratio required to fully reduce the titanium chloride salt to titanium metal; wherein the concentration of titanium powder in the fluid suspension of titanium powder in molten salt in the reactor is between 2 and 23 mass %; and the reducing metal is lithium, sodium, magnesium, or calcium.

During the reduction process, contaminated titanium is concentrated in the peripheral zones. Salt that evaporates in the high temperature parts of the reactor deposits in colder sections of the reactor. And the subsequent supply of the reducing metal triggers the formation of large crystals which from the first portions are sintered together with the previously formed dispersed titanium into a dense mass, which in the form of a continuous layer is located at the level of the initial melt and blocks the cross section of the reactor. This makes it difficult for the reducing metal to penetrate into the reaction zone and the reduction process is inhibited.

U.S. Pat. No. 10,316,391B2 (Publication Date: Feb. 8, 2018) describes a method in which a composition comprising a titanium oxide source is loaded into a reaction chamber along with an excess of a composition comprising an Mg source, such as Mg powder, Mg granules, Mg nanoparticles, or Mg/Ca eutectics. It is preferable that reduction of composition comprising a titanium oxide source proceeds without direct physical contact between the composition comprising an Mg source in order to reduce the potential for contamination of the resulting titanium product. The reaction chamber is then sealed with a lid, saturated with a noble gas, and heated to an internal temperature of 800-1000° C. As long as the temperature is sufficient to vapourize Mg, the reaction will occur. The reaction is carried out for at least 30 minutes, and preferably between 30 minutes-120 minutes. Then, the reaction chamber is cooled to room temperature, and the resulting product is washed with one or more washing media including but not limited to dilute acids (such as HCl, $HNO_3$, and $H_2SO_4$) and water (e.g., deionized water). In other embodiments, $Mg^{2+}$ impurities can be removed by ultra sound assisted water or dilute acid washing. The resulting product is then dried.

In the known method, the reduction process is difficult or does not proceed completely due to the fact that reduction reaction products block the titanium oxide source particles and the access of fresh portions of magnesium vapor to the particle surface is terminated. Due to this the required reduction level is not achieved, and also side reactions occur that have a negative effect on the equipment.

Technical Problem

The present invention has been accomplished in view of the above-described problems known from the prior art, and the aim of the present invention is to provide an industrial method for the production of alloy powders of titanium metal with a particularly low oxygen content, which is required for the production of titanium products with special characteristics, for example, in order to achieve characteristics corresponding, but not limited to CP Grade 1 titanium or to meet even higher requirements for oxygen content.

The proposed invention makes it possible to obtain in an inexpensive way powders of various titanium alloys by obtaining titanium oxide particles with the required particle size distribution and the formation of feedstock elements characterized by a certain shape and porosity from solid solutions of dopant oxides in crystalline titanium oxide and their subsequent co-reduction with calcium in a one-step process or with magnesium and calcium in a two-step process using the techniques described in the present invention. At the same time, due to the uniform distribution of dopants because of dispersion of their oxides in crystalline titanium oxide, the alloys obtained as a result of reduction are characterized by an extremely high distribution of dopants in titanium metal, which ensures extremely high homogeneity of alloys.

The authors have unexpectedly found that the efficiency of reduction of titanium oxide to titanium metal depends on the particle size distribution of crystalline titanium oxide which is used to form feedstock elements for reduction. So, if titanium oxide particles are too small, for example, if titanium oxide pigment with a primary particle size of 0.1-0.5 μm is used, it is extremely difficult to obtain titanium metal with low oxygen content in a one-step process using calcium as a reducing agent or high titanium content after the first step in a two-step process using magnesium as a reducing agent. In this case, it does not matter what excess amounts of reducing agents are used, since the reduction reaction does not proceed completely due to the fact that reduction reaction products block the reduced material particles and the access of fresh portions of the reducing agent to the particle surface is terminated. Therefore, the required reduction level is not achieved, and also the reducing agent is wasted.

To ensure the free running of the reduction process, the authors of the invention proposed a new method for loading feedstock elements and a reducing agent, which allows reduction with the help of reducing agent vapors. Penetrating into the feedstock elements, said vapors are oxidized to form oxides, which leads to the expansion of feedstock elements and their mechanical fixation at the level between themselves and between the walls of the crucible in which they are installed. Thus, this ensures that the feedstock elements are located above the layer of the boiling reducing agent melt and the reduction occurs in the entire volume of the elements without breakage of their bodies. Also, such a process prevents coagulation and sintering of alloy particles, and precipitation of reducing agent oxides on the walls and bottom of the retort.

The present invention differs from the prior art in that it optimizes the combination of various requirements necessary to achieve the conditions for producing titanium alloy powders with low oxygen content.

SUMMARY OF THE INVENTION

The method for producing alloy powders based on titanium metal is implemented according to the following stages:

a) hydrolysis of an aqueous solution of titanium-containing salt and the formation of a precipitate of titanium oxides and/or hydroxides to obtain primary particles of crystalline titanium oxide with a particle size distribution of 5-50 μm, preferably 10-40 μm, or further preferably 15-30 μm;

b) washing and filtration of the formed precipitate of titanium oxides and/or hydroxides;

c) precipitation of dopant oxides and/or hydroxides on titanium oxides and/or hydroxides precipitate, in which dopant salts are added to the slurry of titanium oxides and/or hydroxides precipitate with a pH in the range of 0.5-12, then the reaction mixture is stirred and the pH of the slurry is adjusted to the range of 1.5-10.0 using aqueous solutions or slurries of one of the alkaline reagents or using acidic reagents;

d) filtration of the resulting reaction mass to separate the cake of titanium oxides and/or hydroxides precipitate with dopant oxides and/or hydroxides precipitated on it from the mother liquor; cake washing;

e) calcination of titanium oxides/hydroxides precipitate with precipitates of dopant oxides and/or hydroxides precipitated on it, which is carried out at a temperature of 400-1300° C. for 0.5-20 hours to obtain a solid solution of dopant oxides in titanium oxide;

f) milling of the powder of a solid solution of dopant oxides in titanium oxide;

g) formation of feedstock elements from a milled powder of a solid solution of dopant oxides in titanium oxide with a strength of at least 10 kg per 1 $cm^2$, preferably at least 15 kg per 1 $cm^2$, optimally at least 20 kg per 1 $cm^2$;

h) reduction of feedstock elements using a reducing agent at an excess pressure in an atmosphere of argon or helium, during which 15-75% of the calculated amount of the reducing agent is loaded into the crucible, on the layer of which feedstock elements are installed; the remaining 25-85% of the calculated amount of the reducing agent being loaded on the surface of feedstock elements; after that an inert filler is loaded onto the surface of the reducing agent, the amount of an inert filler being 10-1000% of the feedstock elements weight, preferably 50-500%, optimally 75-200%;

i) quenching of the reaction mass, during which soaking in water lasts for 1-48 hours, preferably for 3-36 hours, further preferably for 6-12 hours;

j) neutralization of the reaction mass, during which the pH of the reaction mass is maintained at the level of more than 0.5, preferably more than 1, further preferably more than 1.5, using one of acids such as acetic acid, hydrochloric acid, nitric acid;

k) milling of the reaction mass, during which the pH of the reaction mass is maintained in the range of 0.5-7, preferably 1-6, further preferably 1.5-5, and when the pH rises above normal, one of the acids such as acetic acid, hydrochloric acid, nitric acid is introduced into the reaction mass;

l) washing the titanium metal slurry to remove formed reaction products, inert filler, residues of the unreacted reducing agent, and filtration, which is carried out until specific electrical conductivity of 10% slurry of titanium metal in water is less than 100 μS/cm, preferably less than 60 μS/cm, optimally less than 20 μS/cm;

m) drying of the powder resulting from Stage 1) and the classification of the finished product, which is carried out in an atmosphere of an inert gas such as argon, helium, nitrogen, while the humidity of the gases should have a dew point of less than −20° C., preferably less than −30° C., optimally less than −40° C., gas temperature being less than 80° C., preferably less than 60° C., optimally less than 40° C.

Moreover, Stage a) uses aqueous solution of titanium oxychloride ($TiOCl_2$).

Moreover, Stage a) uses aqueous solutions of titanium oxysulfates, titanium nitrates.

Preferably, at Stage c) pH of the slurry is adjusted using acidic reagents, including but not limited to hydrochloric, or sulfuric, or nitric acids or mixtures thereof, or using alkaline agents, including but not limited to ammonium hydroxide, sodium hydroxide, potassium hydroxide, lithium hydroxide, calcium hydroxide, magnesium hydroxide, ammonium carbonate, sodium carbonate, potassium carbonate, lithium carbonate, calcium carbonate, magnesium carbonate.

At Stage c) dopants are selected from, but are not limited to Al, V, Pd, Ru, Ni, Mo, Cr, Co, Zr, Nb, Sn, Si, W, Ta, Fe, and salts introduced at this stage are water-soluble salts of the said dopants of inorganic or organic nature, including but not limited to chlorides, chlorates, sulfates, sulfites, nitrates, nitrites, bromides, bromates, iodides, iodates, acetates, citrates, oxalates, propionates, stearates, gluconates, sulfonates.

At Stage g) formation of feedstock elements takes place, feedstock elements being shaped as, but not limited to hollow cylinders with round or oval cross section, or tubes with triangular or rectangular, or square, or hexagonal, or honeycombed cross section.

At Stage g) feedstock elements are formed with the length of 1-800 mm, preferably 10-50 mm, further preferably 25-200 mm, and wall thickness of feedstock elements is 1-25 mm.

Moreover, feedstock elements with a wall thickness of 1-8 mm have a wall porosity of 20-70 vol. %, preferably 40-70 vol. %, optimally 55-65 vol. %, and feedstock elements with a wall thickness of 9-25 mm have a wall porosity 55-85 vol. %, preferably 60-80 vol. %, optimally 65-75 vol. %.

In the specific embodiment of the invention, calcium metal is used as a reducing agent at Stage h).

Moreover, magnesium metal is used, comprising granules with the size of 0.1-30 mm, preferably 1-15 mm, optimally 2-10 mm or lumps of 30-500 mm in size, preferably 50-400 mm, optimally 100-200 mm, or sheets with a thickness of 1 to 100 mm, a width of 30 to 1500 mm and a length of 30 to 1500 mm.

Moreover, feedstock elements at Stage h) are installed so that the through holes in them are directed vertically.

Preferably, Stage h) uses an inert filler comprising metal halides of Groups 1-2 of the Periodic Table or their mixtures in various proportions including, for example, calcium chloride ($CaCl_2$), potassium chloride (KCl, magnesium chloride ($MgCl_2$), sodium chloride (NaCl), but not limited to these salts or mixtures thereof.

Preferably, at Stage h) heating rate of the furnace, the retort with the crucible being placed in it, is set at 1-6° C./min, preferably 2-5° C./min, optimally 3-4° C./min.

Preferably, at Stage h) after heating the retort to a temperature of 850-950° C., preferably 870-940° C., optimally 880-930° C., heating is stopped and the first holding is performed for 0.5-8 hours, preferably 1-6 hours, optimally 2-4 hours. After the first holding time is over, the furnace temperature is raised at a rate described above to 960-1100° C., preferably 970-1050° C., optimally 980-1030° C., and at this temperature the second holding is carried out for 1-48 hours, preferably 2-36 hours, optimally 4-24 hours. After the reduction time has elapsed, the retort is cooled to a temperature of 20-300° C., preferably 25-200° C., optimally 30-80° C., at a rate of 1-5° C./min, preferably 1-3° C./min, optimally 1.5-2° C./min.

Moreover, reaction mass milling at Stage k) is carried out in a ball mill with a milling chamber being made of titanium and 25-85% filled with milling media.

Moreover, the final moisture content of the powder after drying at Stage m) should not exceed 0.2%, and should preferably be less than 0.1%, further preferably less than 0.05%.

According to some non-limiting embodiments the method for producing alloy powders based on titanium metal is carried out in accordance with the following stages:

a) hydrolysis of an aqueous solution of titanium-containing salt and the formation of a precipitate of titanium oxides and/or hydroxides to obtain primary particles of crystalline titanium oxide with a particle size distribution of 5-50 μm, preferably 10-40 μm, or further preferably 15-30 μm;

b) washing and filtration of the formed precipitate of titanium oxides and/or hydroxides;

c) precipitation of dopant oxides and/or hydroxides on titanium oxides and/or hydroxides precipitate, in which dopant salts are added to the slurry of titanium oxides and/or hydroxides precipitate with a pH in the range of 0.5-12, then the reaction mixture is stirred and the pH of the slurry is adjusted to the range of 1.5-10.0 using aqueous solutions or slurries of one of the alkaline reagents or using acidic reagents;

d) filtration of the resulting reaction mass to separate the cake of titanium oxides and/or hydroxides precipitate with dopant oxides and/or hydroxides precipitated on it from the mother liquor; cake washing;

e) calcination of titanium oxides/hydroxides precipitate with precipitates of dopant oxides and/or hydroxides precipitated on it, which is carried out at a temperature of 400-1300° C. for 0.5-20 hours to obtain a solid solution of dopant oxides in titanium oxide;

f) milling of the powder of a solid solution of dopant oxides in titanium oxide;

g) formation of feedstock elements from a milled powder of a solid solution of dopant oxides in titanium oxide with a strength of at least 10 kg per 1 $cm^2$, preferably at least 15 kg per 1 $cm^2$, optimally at least 20 kg per 1 $cm^2$ regardless of which side the load is applied to the feedstock element;

h) reduction of feedstock elements using a reducing agent, during which 15-75% of the calculated amount of the reducing agent is loaded into the crucible, on the layer of which feedstock elements are installed; the remaining 25-85% of the calculated amount of the reducing agent being loaded on the surface of feedstock elements; after that an inert filler is loaded onto the surface of the reducing agent, the amount of an inert filler being 10-1000% of the feedstock elements weight, preferably 50-500%, optimally 75-200%;

i) quenching of the reaction mass, during which soaking in water lasts for 1-48 hours, preferably for 3-36 hours, further preferably for 6-12 hours;

j) neutralization of the reaction mass, during which the pH of the reaction mass is maintained at the level of more than 0.5, preferably more than 1, further preferably more than 1.5, using one of acids such as acetic acid, hydrochloric acid, nitric acid;

k) milling of the reaction mass, during which the pH of the reaction mass is maintained in the range of 0.5-7, preferably 1-6, further preferably 1.5-5, and when the pH rises above normal, one of the acids such as acetic acid, hydrochloric acid, nitric acid is introduced into the reaction mass;

l) washing the titanium metal slurry to remove formed reaction products, inert filler, residues of the unreacted reducing agent, and filtration, which is carried out until specific electrical conductivity of 10% slurry of titanium metal in water is less than 100 μS/cm, preferably less than 60 S/cm, optimally less than 20 μS/cm;

m) drying of the powder resulting from Stage l);

n) reduction of the powder obtained at Stage m), using a reducing agent, during which the reducing agent is placed on the bottom of the crucible, and then a layer of the powder to be reduced is placed on it, so that the mass ratio of the thickness of the reducing agent layer covering the bottom of the crucible to the powder to be reduced is in the range from 1:35 to 2:1. Then, the layer of the powder to be reduced is covered again by a new layer of the reducing agent; this procedure is repeated until the crucible is fully loaded from top to bottom;

o) quenching of the reaction mass, during which soaking in water lasts for 1-48 hours, preferably for 3-36 hours, further preferably for 6-12 hours;

p) neutralization of the reaction mass, during which the pH of the reaction mass is maintained at the level of more than 0.5, preferably more than 1, further preferably more than 1.5, using one of acids such as acetic acid, hydrochloric acid, nitric acid;

q) milling of the reaction mass, during which the pH of the reaction mass is maintained in the range of 0.5-7, preferably 1-6, further preferably 1.5-5, and when the pH rises above normal, one of the acids such as acetic acid, hydrochloric acid, nitric acid is introduced into the reaction mass;

r) washing the titanium metal slurry to remove formed reaction products, inert filler, residues of the unreacted reducing agent, and filtration, which is carried out until specific electrical conductivity of 10% slurry of titanium metal in water is less than 100 μS/cm, preferably less than 60 μS/cm, optimally less than 20 μS/cm;

s) drying of the powder resulting from Stage r) and the classification of the finished product, which is carried out in an atmosphere of an inert gas such as argon, helium, nitrogen, while the humidity of the gases should have a dew point of less than −20° C., preferably less than −30° C., optimally less than −40° C., gas temperature being less than 80° C., preferably less than 60° C., optimally less than 40° C.

Moreover, Stage a) uses aqueous solution of titanium oxychloride ($TiOCl_2$).

Moreover, Stage a) uses aqueous solutions of titanium oxysulfates, titanium nitrates.

Preferably, at Stage c) pH of the slurry is adjusted using acidic reagents, including but not limited to hydrochloric, or sulfuric, or nitric acids or mixtures thereof, or using alkaline agents, including but not limited to ammonium hydroxide, sodium hydroxide, potassium hydroxide, lithium hydroxide, calcium hydroxide, magnesium hydroxide, ammonium carbonate, sodium carbonate, potassium carbonate, lithium carbonate, calcium carbonate, magnesium carbonate.

At Stage c) dopants are selected from, but are not limited to Al, V, Pd, Ru, Ni, Mo, Cr, Co, Zr, Nb, Sn, Si, W, Ta, Fe, and salts introduced at this stage are water-soluble salts of the said dopants of inorganic or organic nature, including but not limited to chlorides, chlorates, sulfates, sulfites, nitrates, nitrites, bromides, bromates, iodides, iodates, acetates, citrates, oxalates, propionates, stearates, gluconates, sulfonates.

At Stage g) formation of feedstock elements takes place, feedstock elements being shaped as, but not limited to hollow cylinders with round or oval cross section, or tubes with triangular or rectangular, or square, or hexagonal, or honeycombed cross section.

At Stage g) feedstock elements are formed with the length of 1-800 mm, preferably 10-50 mm, further preferably 25-200 mm, and wall thickness of feedstock elements is 1-25 mm.

Moreover, feedstock elements with a wall thickness of 1-8 mm have a wall porosity of 20-70 vol. %, preferably 40-70 vol. %, optimally 55-65 vol. %, and feedstock elements with a wall thickness of 9-25 mm have a wall porosity 55-85 vol. %, preferably 60-80 vol. %, optimally 65-75 vol. %.

In the specific embodiment of the invention, calcium metal or magnesium metal are used as a reducing agent at Stage h).

Moreover, calcium metal is used, comprising granules with the size of 0.1-30 mm, preferably 1-15 mm, optimally 2-10 mm or lumps of 30-500 mm in size, preferably 50-400 mm, optimally 100-200 mm, or sheets with a thickness of 1 to 100 mm, a width of 30 to 1500 mm and a length of 30 to 1500 mm.

Moreover, magnesium metal is used, comprising granules with the size of 0.1-30 mm, preferably 1-15 mm, optimally 2-10 mm or lumps of 30-500 mm in size, preferably 50-400 mm, optimally 100-200 mm, or sheets with a thickness of 1 to 100 mm, a width of 30 to 1500 mm and a length of 30 to 1500 mm.

Moreover, feedstock elements at Stage h) are installed so that the through holes in them are directed vertically.

Preferably, Stage h) uses an inert filler comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof.

Preferably, at Stage h) heating rate of the furnace, the retort with the crucible being placed in it, is set at 1-6° C./min, preferably 2-5° C./min, optimally 3-4° C./min.

Preferably, at Stage h) after heating the retort to a temperature of 850-950° C., preferably 870-940° C., optimally 880-930° C., heating is stopped and the first holding is performed for 0.5-8 hours, preferably 1-6 hours, optimally 2-4 hours. After the first holding time is over, the furnace temperature is raised to 960-1100° C., preferably 970-1050° C., optimally 980-1030° C., and at this temperature the second holding is carried out for 1-48 hours, preferably 2-36 hours, optimally 4-24 hours. After the reduction time has elapsed, the retort is cooled to a temperature of 20-300° C., preferably 25-200° C., optimally 30-80° C., at a rate of 1-5° C./min, preferably 1-3° C./min, optimally 1.5-2° C./min.

Preferably, at Stage h) after heating the retort to a temperature of 650-800° C., preferably 670-770° C., optimally 680-750° C., heating is stopped and the first holding is performed for 0.5-8 hours, preferably 1-6 hours, optimally 2-4 hours. After the first holding time is over, the furnace temperature is raised to 820-1050° C., preferably 830-1020° C., optimally 850-950° C., and the holding is carried out for 1-48 hours, preferably 2-36 hours, optimally 4-24 hours. After the reduction time has elapsed, the retort is cooled to a temperature of 20-300° C., preferably 25-200° C., optimally 30-80° C., at a rate of 1-5° C./min, preferably 1-3° C./min, optimally 1.5-2° C./min.

Moreover, reaction mass milling at Stages k) and q) is carried out in a ball mill with a milling chamber being made of titanium and 25-85% filled with milling media.

Moreover, the final moisture content of the powder after drying at Stage m) should not exceed 0.2%, and should preferably be less than 0.1%, further preferably less than 0.05%.

Moreover, calcium metal is used as a reducing agent at Stage n).

Stage n) additionally uses an inert filler comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof.

Moreover, the inert filler is taken in the amount of 10-1000% of the feedstock elements weight, preferably 50-500%, optimally 75-200%.

Moreover, the inert filler is loaded as the top layer after the main ingredients have been loaded.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

In the present description of non-limiting embodiments of the invention and in the claims, except for working examples or where it is otherwise indicated, all numbers expressing quantities or characteristics of ingredients and products, processing conditions and the like, should be understood as modifiable in all cases by the terms "about", "approximately", "around". Accordingly, unless otherwise indicated, any numerical parameters given in the following description and the appended claims, are approximations that may vary depending on the desired characteristics to be obtained in the methods and devices in accordance with this disclosure. At a minimum, and without attempting to limit the application of the doctrine of equivalents to the scope of the claims, each numerical parameter should be considered in light of the number of significant figures shown and using standard rounding-off methods.

DESCRIPTION OF AN EMBODIMENT OF THE INVENTION

Figure 1:
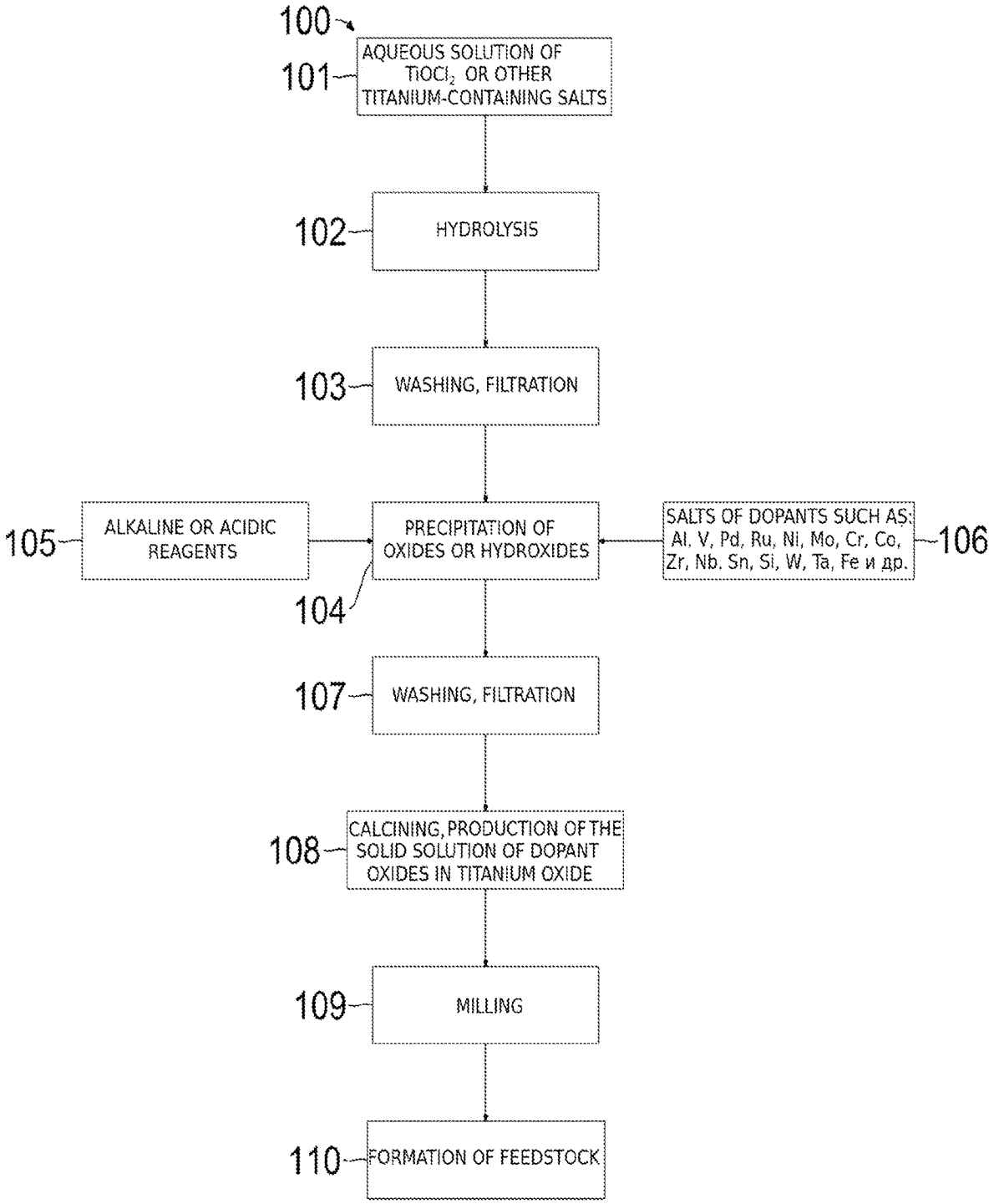
FIG. 1 shows an illustrative diagram of the preparation stage of the claimed method for producing alloy powders based on titanium metal, resulting in the production of formed feedstock elements.

With reference to FIG. 1, the preparation stage 100 of the claimed method, resulting in the production of the formed feedstock elements 110, includes the following stages: hydrolysis 102, washing and filtration 103, precipitation of solid solutions of dopant oxides and/or hydroxides in crystalline titanium oxide 104, adjusting pH of the slurry using acidic or alkaline reagents 105, dopant salts adding 106, filtering and washing the cake 107, calcining the precipitate of titanium oxides and/or hydroxides 108, milling 109 and forming feedstock elements 110.

As noted above, the production of alloy powders based on titanium metal in accordance with the described and claimed concept (concepts) of the present invention begins with the production of crystalline titanium oxide with dopants dissolved in its crystal lattice; said titanium oxide is then used for the formation of feedstock elements for reduction. Provided that primary particles with a particle size distribution of 5-50 μm, preferably 10-40 μm, further preferably 15-30 μm, are used for the production of feedstock elements, the resulting feedstock elements, all other conditions being equal, are subjected to reduction with high efficiency, which allows achieving very low oxygen content values in a one-step process, as well as high Ti content after the first step in a two-step process.

To obtain primary particles of crystalline titanium oxide with a particle size distribution of 5-50 μm, preferably 10-40 μm, further preferably 15-30 μm, the authors of the invention have developed a technology for hydrolysis of titanium oxychloride solutions, said hydrolysis being controlled in a special way, which consists in the following:

Before hydrolysis, the solution must not contain $Fe^{3+}$ ions; the $Ti^{3+}$ content must be 0.2-3.0 g/dm$^3$ on $TiO_2$ basis; the tank in which the hydrolysis is carried out must be sealed to avoid air entering it from the outside to prevent oxidation of $Fe^{2+}$ to $Fe^{3+}$ and contamination of the titanium oxide/hydroxide obtained after hydrolysis with iron compounds.

Thermal hydrolysis 102 to form titanium oxide/hydroxides precipitate includes the following stages:

Dissolution of water-soluble titanium oxychloride ($TiOCl_2$) in distilled or demineralized water at $TiO_2$ concentration of 50-400 g/dm$^3$. The solution, that is, the reaction mixture 101, thus obtained, is subjected to filtration and transferred to a heated hydrolysis reactor equipped with a condenser. Next, the filtered titanium oxychloride solution ($TiOCl_2$) with a $TiO_2$ concentration of 50-400 g/dm$^3$, having a temperature of 10-60° C., is heated to a temperature of 70-95° C. during 10-120 minutes.

After the hydrolysis 102 is started, the reactor temperature is raised during 10-60 minutes to a boiling point of 100-120° C., and the solution is boiled for 3-6 hours until the yield of $TiO_2$ is at least 95%. The yield of $TiO_2$ was determined as the ratio of $TiO_2$ amount precipitated during hydrolysis to the total amount of $TiO_2$ before the hydrolysis.

Hydrochloric acid vapors released during this process are removed from the hydrolysis reactor through a heat exchanger irrigated with cooled water with a temperature of +7° C., where hydrochloric acid condenses to have 35% HCl content. The hydrochloric acid solution is continuously removed from the condenser and collected in a separate tank.

Washing and filtration 103 are as follows: the reaction mixture is cooled to a temperature of 20-70° C. and the reaction product can be separated by filtration and then washed with demineralized water until it principally ceases to contain impurities of other elements (iron, vanadium, chromium and others, depending on what impurities were contained in the initial titanium oxychloride solution) to the level required to produce a particular grade of titanium metal.

Nevertheless, although the above described the production of particles with size distribution required for the purposes of the invented technology, from titanium oxychloride solutions, this invention is not limited only to the use of titanium oxychloride for these purposes, but also covers the use of other precursors to obtain particles with size distribution required for the purposes of the invented technology, including but not limited to titanium oxysulfates/titanium nitrates solutions.

Precipitation of solid solutions of dopant oxides and/or hydroxides in crystalline titanium oxide 104 is performed in the following way: washed titanium oxide and/or hydroxide powder is dispersed in the precipitation reactor with demineralized water to obtain a concentration of 50-600 g/dm$^3$ on $TiO_2$ basis, after which the pH of the slurry is adjusted using acidic reagents 105, including but not limited to hydrochloric, or sulfuric, or nitric acids or mixtures thereof, or using alkaline agents 105, including but not limited to ammonium hydroxide, sodium hydroxide, potassium hydroxide, lithium hydroxide, calcium hydroxide, magnesium hydroxide, ammonium carbonate, sodium carbonate, potassium carbonate, lithium carbonate, calcium carbonate, magnesium carbonate, to such a pH range at which no precipitation of dopant oxides from salt solutions added thereafter occurs in the pH range from 0.5 to 12.

Exemplarily, in the preparation of alloys containing zirconium, including, for example, an alloy such as Grade 19, but not limited to it, various water-soluble zirconium salts can be used, said salts including but not limited to zirconium oxychloride or zirconium oxysulfate, while the pH of the slurry of titanium oxide/hydroxide precipitates must be adjusted to pH=1 or less, since at this pH the hydrolysis of said zirconium salts does not occur and the zirconium remains in a dissolved state.

In the case of producing alloys with aluminum, including but not limited to Grade 37, various water-soluble aluminum salts can be used, including but not limited to aluminum sulfate or aluminum oxychloride, while the pH of the slurry of titanium oxide and/or hydroxide precipitates should be adjusted to pH=2.5 or less, since at this pH the hydrolysis of said aluminum salts does not occur and the aluminum remains in a dissolved state.

In the case of producing alloys with silicon, including but not limited to Grade 35, various water-soluble silicon salts can be used, including but not limited to sodium or potassium silicates, while the pH of the slurry of titanium oxide/hydroxide precipitates should be adjusted to pH=10.0 or more, since at this pH the hydrolysis of said silicon salts does not occur and the silicon remains in a dissolved state.

After adjusting the pH of the slurry of titanium oxides and/or hydroxides precipitate to the required level, the corresponding dopant salts 106 are added, depending on which alloy is to be obtained. Dopants can be selected from, but are not limited to Al, V, Pd, Ru, Ni, Mo, Cr, Co, Zr, Nb, Sn, Si, W, Ta, Fe, while salts introduced at this stage being water-soluble salts of the said dopants of inorganic or organic nature, including but not limited to chlorides, chlorates, sulfates, sulfites, nitrates, nitrites, bromides, bromates, iodides, iodates, acetates, citrates, oxalates, propionates, stearates, gluconates, sulfonates.

After adding the salts of the corresponding dopants 106, the reaction mixture is thoroughly mixed to achieve a complete distribution of the added salts in the volume of the slurry of titanium oxides and/or hydroxides precipitate.

After that, to carry out the precipitation 104 of oxides/hydroxides of the corresponding dopants, the pH of the slurry is gradually adjusted to 1.5-10.0 using aqueous solutions or slurries of one of alkaline agents including but not limited to ammonium hydroxide, sodium hydroxide, potassium hydroxide, lithium hydroxide, calcium hydroxide, magnesium hydroxide, ammonium carbonate, sodium carbonate, potassium carbonate, lithium carbonate, calcium carbonate, magnesium carbonate, or combinations thereof, or using acidic reagents including but not limited to hydrochloric, or sulfuric, or nitric acids. In this case, a uniform precipitation of oxides and/or hydroxides of the corresponding dopants can be observed in the entire volume of titanium oxides and/or hydroxides precipitate.

After that, the resulting reaction mass is subjected to filtration to separate the precipitate cake from the mother liquor, and the resulting cake is washed 107 with water to remove water-soluble compounds.

Calcination of titanium oxides/hydroxides precipitate with coprecipitated oxides and/or hydroxides of dopants in order to obtain a solid solution of dopant oxides in the crystal lattice of crystalline titanium oxide 108 proceeds as described below.

Having been obtained at Stage 107, the cake of titanium oxides/hydroxides with aluminum and vanadium oxides/hydroxides uniformly precipitated in it is squeezed out in a filter press and fed into a drum-type calcining furnace for calcination 108; said calcining furnace being heated by electric heating elements, by gas or other energy sources, including but not limited to syngas, fuel oil, hydrogen.

During calcination 108, free and crystalline moisture is removed, and the crystalline structure of titanium oxide is formed. Also, in the case of calcining titanium oxides and/or hydroxides with precipitates of dopant oxides, dopant oxides dissolve in the crystal lattice of titanium oxides, thereby ensuring an extremely uniform distribution of dopants in the titanium oxide.

The temperature of calcination of titanium oxides/hydroxides precipitate with precipitates of dopant oxides is 400-1300° C., preferably 600-1250° C., further preferably 900-1100° C. Calcination time at the said temperatures is 0.5-20 hours, preferably 1-15 hours, further preferably 1.5-10 hours, which ensures complete dissolution of dopants in the crystal lattice of titanium oxide.

The powder of dopants solution in titanium oxide obtained after calcination 108 is subjected to milling for the purpose of deaggregation/deagglomeration which occurred during calcination, using, for example, a centrifugal mill.

After that, the milled powder of dopant oxides dissolved in titanium oxide is used for the formation of feedstock elements 110 by applying methods known in the art, including but not limited to slip casting, extrusion; feedstock elements 110 being feedstock processed in a special way, which is given a special geometric shape, and for which the specified porosity and mechanical strength are attained.

The formation process results in the production of feedstock elements, which are shaped as hollow cylinders with round or oval cross section, or tubes with triangular or rectangular, or square, or hexagonal, or honeycombed cross section, but are not limited to them. Furthermore, the length of feedstock elements is 1-800 mm, preferably 10-50 mm, further preferably 25-200 mm. In addition, wall thickness of feedstock elements is 1-25 mm. It is preferable that feedstock elements with a wall thickness of 1-8 mm have a wall porosity of 20-70 vol. %, preferably 40-70 vol. %, optimally 55-65 vol. %, and feedstock elements with a wall thickness of 9-25 mm have a wall porosity 55-85 vol. %, preferably 60-80 vol. %, optimally 65-75 vol. %.

The strength of feedstock elements must be sufficient so that a feedstock element can sustain without breakage a load of at least 10 kg per 1 $cm^2$, preferably at least 15 kg per 1 $cm^2$, optimally at least 20 kg per 1 $cm^2$, regardless of which side the load is applied to the feedstock element. The authors of the invention have noticed that if the strength of feedstock elements is not sufficient, feedstock elements breakage can occur during the reduction process, which leads to incomplete reduction in places where feedstock elements are broken, due to restriction or even blocking of the access of a reducing agent to these places.

Figure 2:
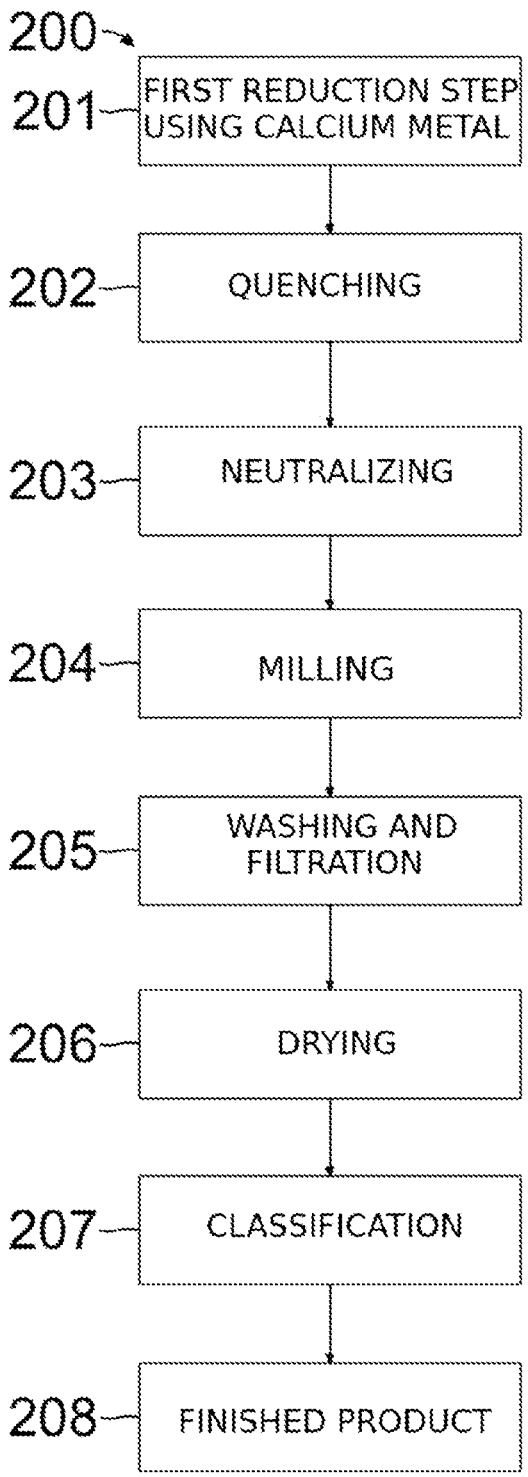
FIG. 2 shows an illustrative diagram of the one-step process for the reduction of feedstock elements using calcium metal.

With reference to FIG. 2 which shows an illustrative diagram of a one-step process for the reduction of feedstock elements formed at Stage 110, a detailed description of the process is provided below. For the said process, the authors of the invention used calcium metal as a reducing agent.

In the present invention, to obtain the powder of titanium metal alloy with dopants in a one-step process 200, the amount of calcium metal as a reducing agent is calculated for the reduction of titanium oxide and for the reduction of dopant oxides dissolved in titanium oxide on a separate basis. For titanium oxide, the amount of calcium metal for the reduction of titanium oxide is taken in excess with respect to the stoichiometric ratio according to Equation (1) in the amount of 1-50%, preferably 5-40%, optimally 10-25%.

$$2Ca+TiO_2=Ti+2CaO \quad (1)$$

The reduction can proceed through a number of intermediate reactions described in Equations (2-8):

$$5TiO_2+Ca=Ti_4O_7+CaTiO_3 \quad (2)$$

$$Ti_4O_7+Ca=5Ti_3O_5+CaTiO_3 \quad (3)$$

$$3Ti_3O_5+Ca=4Ti_2O_3+CaTiO_3 \quad (4)$$

$$2Ti_2O_3+Ca=3TiO+CaTiO_3 \quad (5)$$

$$CaTiO_3+TiO=CaTi_2O_4 \quad (6)$$

$$CaTi_2O_4+Ca=2TiO+2CaO \quad (7)$$

$$TiO+Ca=Ti+CaO \quad (8).$$

To reduce the oxide of the dopant dissolved in titanium oxide crystal lattice to metal, calcium metal is taken in excess with respect to the stoichiometric ratio according to Equation (9) in the amount of 1-50%, preferably 5-40%, optimally 10-25%.

$$yCa+Me_xO_y=xMe+yCaO \quad (9).$$

Figure 5:
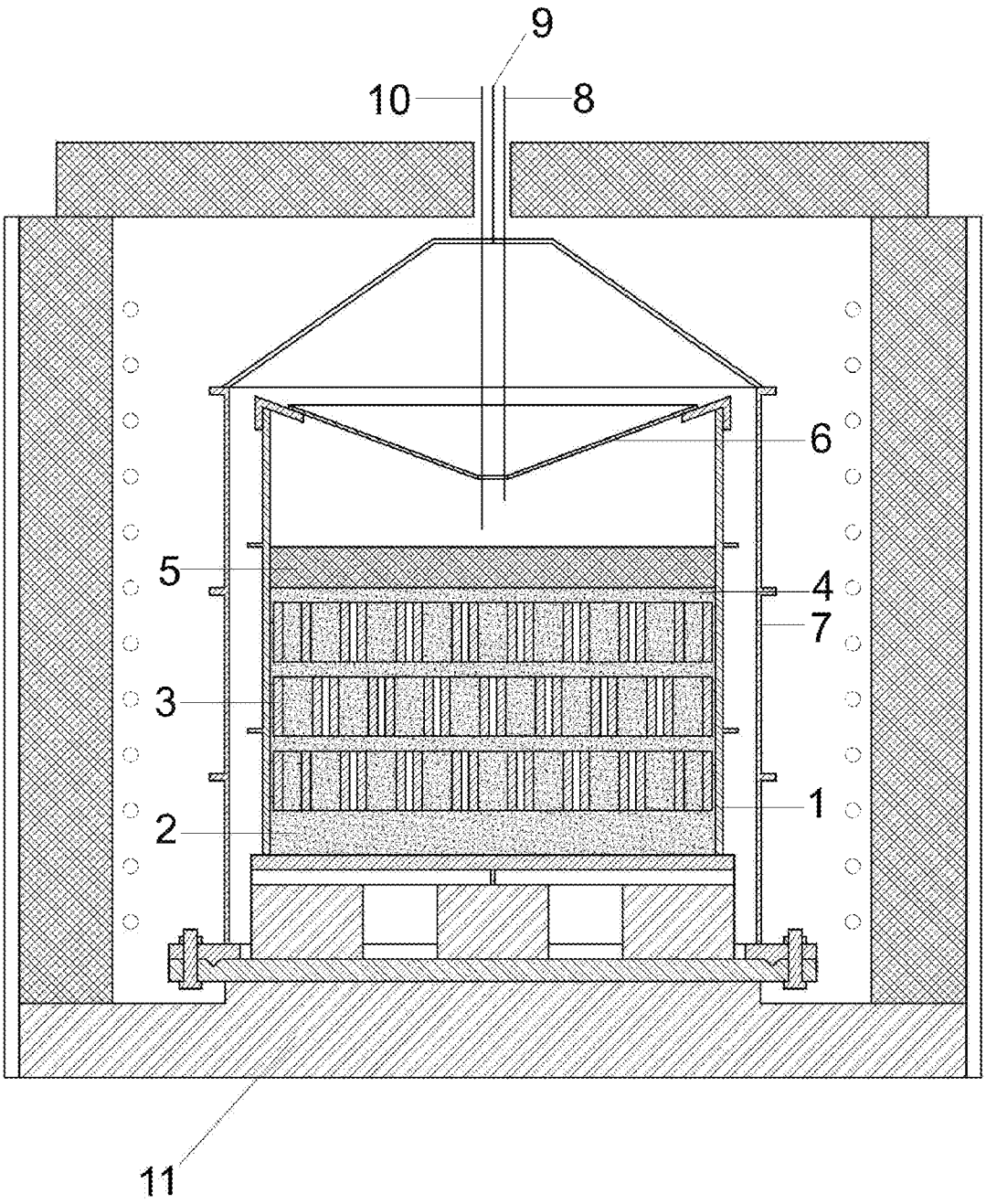
FIG. 5 shows a schematic illustration of the plant used for the reduction of feedstock elements both in a one-step and a two-step process.

The reduction process 201 proceeds as follows. As shown in FIG. 5, a crucible 1 made of titanium, preferably of CP Ti Grade 2, is filled with 15-75% of the calculated amount of calcium metal 2, comprising granules with the size of 0.1-30 mm, preferably 1-15 mm, optimally 2-10 mm. Calcium metal can also be used in the form of lumps of 30-500 mm in size, preferably 50-400 mm, optimally 100-200 mm, or sheets with a thickness of 1 to 100 mm, a width of 30 to 1500 mm and a length of 30 to 1500 mm.

Further, feedstock elements 3 are installed on the layer of calcium 2 lying on the bottom of the crucible, so that the through holes in them are directed vertically, which ensures the free passage of calcium vapors during the reduction process and their equal access to all surfaces of the feedstock elements.

After that, the remaining 25-85% of the calculated amount of calcium metal (upper layer of calcium 4) is loaded onto the surface of the feedstock elements 3 so that the upper part of the feedstock elements 3 is completely covered with calcium metal. After that, an inert filler 5 is loaded onto the surface of calcium metal 4; the inert filler comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof. The inert filler is taken in the amount of 10-1000% of the feedstock elements weight, preferably 50-500%, optimally 75-200%.

An important feature of the loading of the reducing agent and feedstock elements is the arrangement of such conditions that allow for the reduction using reducing agent vapors. The beginning of reduction is followed by the release of reducing agent vapors; penetrating into the feedstock elements, said vapors are oxidized to form oxides, which leads to the expansion of feedstock elements and their mechanical fixation at the level between themselves and between the walls of the crucible in which they are installed. Thus, this ensures that the feedstock elements are located above the bed of boiling reducing agent melt. The first part of the reduction process proceeds quite vigorously and is accompanied by significant exothermic effects, which can lead to significant overheating of the reaction mixture to extremely high temperatures. Such high temperatures are undesirable both in terms of adverse side reactions and in terms of the impact on equipment (the crucible, the retort, etc.). Using of an inert filler solves this issue, since the heat released sharply in the first part of the process is immediately consumed to melt the inert filler, which reduces the reaction mixture temperature to the required values and prevents by-products generation and negative effects on the equipment.

After loading all the components, the titanium crucible is covered with a titanium cover 6 and installed on the lower flange of the retort 7 with a gasket and covered with the cylindrical part of the retort. After that the retort is sealed with a bolted joint (not shown). The retort has inlet nozzles for the inert gas 8 and evacuation 9, as well as a thermocouple 10. After the retort is sealed, a series of operations are performed to evacuate the retort and fill it with an inert gas, for example, argon or helium, to completely remove air residues from the retort, during 0.5-8 hours, preferably 1-6 hours, further preferably 2-4 hours. After the procedure to extract the remaining air is completed, the retort is left under an excess pressure of the inert gas throughout the reduction process to prevent air from entering the retort from the outside in case of the retort seal failure. It is possible to prepare the retort without the evacuation process; in this case the retort is purged with an inert gas, for which the inert gas discharge valve should be opened so that the remaining air is released from the inner part of the retort. The retort is made of heat resistant steel including but not limited to AISI 310S.

After the time controlled removal of the remaining air from the retort, the retort is transferred to the furnace 11, which can be but is not limited to a shaft- or tunnel-type furnace. An inert gas, such as nitrogen, argon, helium is continuously, during the reduction process, fed into the inner space of the furnace, where the heating elements are located, in order to avoid oxidation of the material of which the retort is made.

Furnace heating rate, the retort being placed in the furnace, is set at 1-6° C./min, preferably 2-5° C./min, optimally 3-4° C./min.

After heating the retort to a temperature of 850-950° C., preferably 870-940° C., optimally 880-930° C., heating is stopped and the first holding is performed for 0.5-8 hours, preferably 1-6 hours, optimally 2-4 hours. After the first holding time is over, the furnace temperature is raised at a rate described above to 960-1100° C., preferably 970-1050° C., optimally 980-1030° C., and at this temperature the second holding is carried out for 1-48 hours, preferably 2-36 hours, optimally 4-24 hours. After the reduction time has elapsed, the retort is cooled to a temperature of 20-300° C., preferably 25-200° C., optimally 30-80° C., at a rate of 1-5° C./min, preferably 1-3° C./min, optimally 1.5-2° C./min.

After cooling the retort, the flange bolted joint is disconnected and the crucible with the reacted mass is sent to the following stages: quenching 202, neutralizing 203, milling 204, washing to remove the reaction products formed, inert filler and residues of unreacted calcium and filtration 205, drying 206, classification 207 of the finished product 208 as described in detail below.

Quenching 202

The crucible with the reaction mass being a densely sintered mixture of titanium metal, calcium oxide, the remains of calcium metal and the inert filler, is placed in a reactor, which is filled with an inert gas, such as argon, helium or nitrogen, until air is completely removed from the reactor. After that, the reaction mass is poured with water with a temperature of 5 to 80° C., in a ratio ranging from 2:1 to 20:1 to the reaction mixture mass, and the quenching process is started. The reactor is agitated by, including but not limited to, mixers of various types and/or by pumping water and reaction products through the reactor using a pump. Soaking in water is carried out during 1-48 hours, preferably during 3-36 hours, further preferably during 6-12 hours.

The following chemical reactions take place during soaking in water:

$$CaO+H_2O=Ca(OH)_2 \quad (19)$$

$$Ca+2H_2O=Ca(OH)_2+2H \quad (20)$$

$$Ca+2H_2O=Ca(OH)_2+H_2 \quad (21)$$

$$Ti+2H=TiH_2 \quad (22)$$

$$Ti+H_2=TiH_2 \quad (23).$$

Reactions (22, 23) proceed slowly; accordingly, the amount of $TiH_2$ formed is directly proportional to the time of the process of quenching in water: the longer the quenching time and the less intense the reactions (20, 21), the higher the $TiH_2$ content in the powder. Considering that the reaction of hydrogen insertion into particles is a heterophase reaction to insert a gaseous element into the solid phase, the distribution of hydrogen in the particles of a titanium metal alloy powder is not uniform and varies from a complete absence or minimal amounts in the central part of the particles, which is farthest from the surfaces, to maximum amounts closer to the surface and on the surface of the particles.

Hydrogenation of titanium powder surface or titanium alloy powder surface at this stage offers a certain advantage, since it protects titanium particles from oxidation by oxygen at the next stages of processing, and it also makes the powder of the finished titanium or its alloys less pyrophoric, that is, less prone to spontaneous combustion. During subsequent processing into finished products, hydrogen can be removed from titanium products and titanium alloys to the required values by high-temperature annealing.

During this stage, the ingress of air into the reactor is prevented, and the gaseous hydrogen formed during the reaction is removed from the reactor and disposed of in accordance with safety and environment protection requirements.

Neutralizing 203

After quenching 202 is completed, the reaction mixture is neutralized. Various organic and inorganic acids and mixtures thereof are used for neutralization, they include, but are not limited to, acetic acid, hydrochloric acid, nitric acid, and the like. To do this, one of the above acids with a concentration of 1-100% is fed into the reactor while active stirring, except for hydrochloric acid, which, if used, is fed with a concentration of 1-35%, while the pH of the reaction mass is maintained at the level of more than 0.5, preferably more than 1, further preferably more than 1.5 in order to avoid acid interaction with titanium metal.

In this case, the following reaction occurs:

$$zH_xAR+yCa(OH)_2=Ca_y(AR)_z+z*xH_2O \quad (24),$$

where, x varies from 1 to 3

AR is acid residue.

Neutralization is carried out according to pH; when the increase in pH of the reaction mass slows down to a level of less than +0.5 units per hour, neutralization is stopped.

Milling 204

The specified stage is carried out in a ball mill, where the reaction mass from the previous stage is pumped into. The milling chamber of a ball mill is a sealed drum made of titanium, including preferably CP Ti Grade 2 but not limited to it; said milling chamber is 25-85% filled with milling media. The milling media are made of titanium metal including but not limited to CP Grade 2; the milling media being balls with a diameter of 10 to 100 mm. Also, milling media can be shaped as cylinders with a cross-sectional diameter of cylinders ranging from 10 to 100 mm and a cylinder length ranging from 10 to 200 mm. In the ball mill, the reaction mass is milled to have 100% of particles sized less than 500 μm, preferably less than 250 μm, further preferably less than 160 μm. During milling, the pH of the reaction mass is maintained in the range of 0.5-7, preferably 1-6, further preferably 1.5-5. If the pH rises above normal, one of the above acids is introduced into the reaction mass.

Filtration and Washing 205

After milling 204, the resulting titanium metal slurry is filtered and washed with water to remove water-soluble impurities. Various types of filters can be used for filtration, they include but are not limited to drum vacuum filters, vacuum Nutsche filters, filter presses, candle filters, Moore vacuum filters, cartridge filters. The mother liquor containing dissolved reaction products and salts of the inert filler is sent for regeneration, where the said products are extracted for reuse and by-products are extracted for further sale.

The titanium powder or titanium alloy powder is washed until specific electrical conductivity of 10% slurry of titanium metal in water is less than 100 μS/cm, preferably less than 60 μS/cm, optimally less than 20 μS/cm.

Drying 206

Drying of the resulting powder is performed at temperatures of 30-150° C., preferably 40-130° C., optimally 50-90° C. at an absolute pressure ranging from 0.005 to 0.115 MPa, preferably from 0.010 to 0.090 MPa, further preferably from 0.015 to 0.080 MPa in air, argon, helium, nitrogen. The equipment may include, but is not limited to, spray dryers, vibration dryers, SWIRL FLUIDIZER (GEA) dryers, fluidized bed dryers, shelf dryers, drum dryers. The final moisture content of the powder after drying should not exceed 0.2%, and should preferably be less than 0.1%, further preferably less than 0.05%.

Classification 207

After drying, the finished titanium metal powder 208 is classified by size using one of the various types of classifiers including but not limited to vibrating screens, air (gas) classifiers. The classification is carried out in an inert gas environment such as argon, helium, nitrogen; gas humidity should have a dew point of less than −20° C., preferably less than −30° C., optimally less than −40° C., gas temperature being less than 80° C., preferably less than 60° C., optimally less than 40° C.

The second aspect of the present invention discloses the two-step process for the reduction of feedstock elements, characterized by that the reduction of the feedstock elements formed at Stage 110 is performed in two successive steps resulting in the production of the powder of titanium metal alloys with a particularly low oxygen content. In this two-step process, the authors of the invention used calcium metal or magnesium metal as reducing agents in the first step and calcium metal in the second step.

Figure 3:
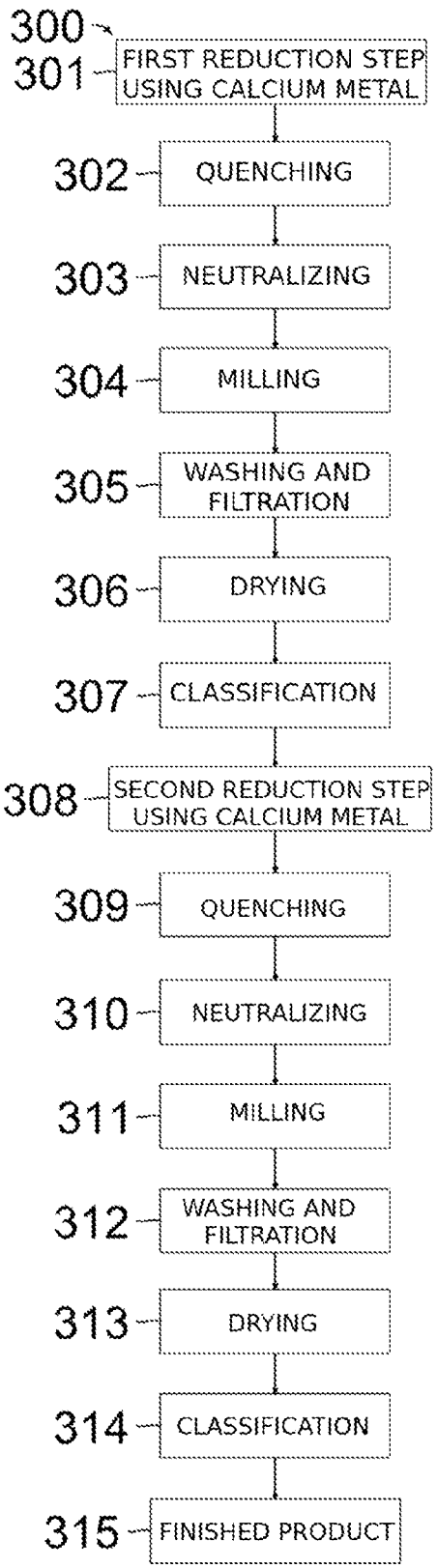
FIG. 3 shows an illustrative diagram of the two-step process for the reduction of feedstock elements using calcium metal.

With reference to FIG. 3 which shows an illustrative diagram of a two-step process for the reduction of feedstock elements formed at Stage 110, a detailed description of the process is provided below. For the said process 300, the authors of the invention used calcium metal as a reducing agent.

The parameters of the first reduction step 301 using calcium metal are as follows:

The amount of calcium metal as a reducing agent is calculated for the reduction of titanium oxide and for the reduction of dopant oxides dissolved in titanium oxide on a separate basis.

For titanium oxide reduction, the amount of calcium metal is taken in the range from 15% deficiency to 40% excess, optimally in the range from 5% deficiency to 15% excess with respect to the stoichiometric ratio according to Equation (1)

$$2Ca+TiO_2=Ti+2CaO \quad (1).$$

The reduction can proceed through a number of intermediate reactions described in Equations (2-8) as described above.

To reduce the dopant oxide dissolved in titanium oxide crystal lattice to metal, calcium metal is taken in the range preferably from 15% deficiency to 40% excess, optimally in the range from 5% deficiency to 15% excess with respect to the stoichiometric ratio according to Equation (9)

$$yCa+Me_xO_y=xMe+yCaO \quad (9).$$

The reduction process (the first step) 301 proceeds as follows. As shown in FIG. 1, a crucible 1 made of titanium, preferably of CP Ti Grade 2, is filled with 15-75% of the calculated amount of calcium metal 2, comprising granules with the size of 0.1-30 mm, preferably 1-15 mm, optimally 2-10 mm. Calcium metal can also be used in the form of lumps of 30-500 mm in size, preferably 50-400 mm, optimally 100-200 mm, or sheets with a thickness of 1 to 100 mm, a width of 30 to 1500 mm and a length of 30 to 1500 mm.

Further, feedstock elements 3 are installed on the layer of calcium 2 lying on the bottom of the crucible, so that the through holes in them are directed vertically, which ensures the free passage of calcium vapors during the reduction process and their equal access to all surfaces of the feedstock elements.

After that, the remaining 25-85% of the calculated amount of calcium metal (upper layer of calcium 4) is loaded onto the surface of the feedstock elements 3 so that the upper part of the feedstock elements 3 is completely covered with calcium metal. After that, an inert filler 5 is loaded onto the surface of calcium metal 4; the inert filler comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof. The inert filler is taken in the amount of 10-1000% of the feedstock elements weight, preferably 50-500%, optimally 75-200%.

An important feature of the loading of the reducing agent and feedstock elements is the arrangement of such conditions that allow for the reduction using reducing agent vapors. The beginning of reduction is followed by the release of reducing agent vapors; penetrating into the feedstock elements, said vapors are oxidized to form oxides, which leads to the expansion of feedstock elements and their mechanical fixation at the level between themselves and between the walls of the crucible in which they are installed. Thus, this ensures that the feedstock elements are located above the bed of boiling reducing agent melt. The first part of the reduction process proceeds quite vigorously and is accompanied by significant exothermic effects, which can lead to significant overheating of the reaction mixture to extremely high temperatures. Such high temperatures are undesirable both in terms of adverse side reactions and in terms of the impact on equipment (the crucible, the retort, etc.). Using of an inert filler solves this issue, since the heat released sharply in the first part of the process is immediately consumed to melt the inert filler, which reduces the reaction mixture temperature to the required values and prevents by-products generation and negative effects on the equipment.

After loading all the components, the titanium crucible is covered with a titanium cover 6 and installed on the lower flange of the retort 7 with a gasket and covered with the cylindrical part of the retort. After that, the retort is sealed with a bolted joint (not shown). The retort has inlet nozzles for the inert gas 8 and evacuation 9, as well as a thermocouple 10. After the retort is sealed, a series of operations are performed to evacuate the retort and fill it with an inert gas, for example, argon or helium, to completely remove air residues from the retort, during 0.5-8 hours, preferably 1-6 hours, further preferably 2-4 hours. After the procedure to extract the remaining air is completed, the retort is left under an excess pressure of the inert gas throughout the reduction process to prevent air from entering the retort from the outside in case of the retort seal failure. It is possible to prepare the retort without the evacuation process; in this case the retort is purged with an inert gas, for which the inert gas discharge valve should be opened so that the remaining air is released from the inner part of the retort. The retort is made of heat resistant steel including but not limited to AISI 310S.

After the time controlled removal of the remaining air from the retort, the retort is transferred to the furnace 11, which can be but is not limited to a shaft- or tunnel-type furnace. An inert gas, such as nitrogen, argon, helium is continuously, during the reduction process, fed into the inner space of the furnace, where the heating elements are located, in order to avoid oxidation of the material of which the retort is made.

Furnace heating rate, the retort being placed in the furnace, is set at 1-6° C./min, preferably 2-5° C./min, optimally 3-4° C./min.

After heating the retort to a temperature of 850-950° C., preferably 870-940° C., optimally 880-930° C., heating is stopped and the first holding is performed for 0.5-8 hours, preferably 1-6 hours, optimally 2-4 hours. After the first holding time is over, the furnace temperature is raised at a rate described above to 960-1100° C., preferably 970-1050° C., optimally 980-1030° C., and at this temperature the second holding is carried out for 1-48 hours, preferably 2-36 hours, optimally 4-24 hours. After the reduction time has elapsed, the retort is cooled to a temperature of 20-300° C., preferably 25-200° C., optimally 30-80° C., at a rate of 1-5° C./min, preferably 1-3° C./min, optimally 1.5-2° C./min.

After cooling the retort, the flange bolted joint is disconnected and the crucible with the reacted mass is sent to the following stages: quenching 302, neutralizing 303, milling 304, washing to remove the reaction products formed, inert filler and residues of unreacted calcium and filtration 305, drying 306, classification 307 of the product as described in detail below.

Quenching 302

The crucible with the reaction mass being a densely sintered mixture of titanium metal, calcium oxide, the remains of calcium metal and the inert filler, is placed in a reactor, which is filled with an inert gas, such as argon, helium or nitrogen, until air is completely removed from the reactor. After that, the reaction mass is poured with water with a temperature of 5 to 80° C., in a ratio ranging from 2:1 to 20:1 to the reaction mixture mass, and the quenching process is started. The reactor is agitated by, including but not limited to, mixers of various types and/or by pumping water and reaction products through the reactor using a pump. Soaking in water is carried out for 1-48 hours, preferably during 3-36 hours, further preferably during 6-12 hours.

The following chemical reactions take place during soaking in water:

$$CaO+H_2O=Ca(OH)_2 \quad (19)$$

$$Ca+2H_2O=Ca(OH)_2+2H \quad (20)$$

$$Ca+2H_2O=Ca(OH)_2+H_2 \quad (21)$$

$$Ti+2H=TiH_2 \quad (22)$$

$$Ti+H_2=TiH_2 \quad (23).$$

Reactions (22, 23) proceed slowly; accordingly, the amount of $TiH_2$ formed is directly proportional to the time of the process of quenching in water: the longer the quenching time and the less intense the reactions (20, 21), the higher the $TiH_2$ content in the powder. Considering that the reaction of hydrogen insertion into particles is a heterophase reaction to insert a gaseous element into the solid phase, the distribution of hydrogen in the particles of a titanium metal alloy powder is not uniform and varies from a complete absence or minimal amounts in the central part of the particles, which is farthest from the surfaces, to maximum amounts closer to the surface and on the surface of the particles.

Hydrogenation of titanium powder surface or titanium alloy powder surface at this stage offers a certain advantage, since it protects titanium particles from oxidation by oxygen at the next stages of processing, and it also makes the powder of the finished titanium or its alloys less pyrophoric, that is, less prone to spontaneous combustion. During subsequent processing into finished products, hydrogen can be removed from titanium products and titanium alloys to the required values by high-temperature annealing.

During this stage, the ingress of air into the reactor is prevented, and the gaseous hydrogen formed during the reaction is removed from the reactor and disposed of in accordance with safety and environment protection requirements.

Neutralizing 303

After the quenching 302 is completed, the reaction mixture is neutralized. Various organic and inorganic acids and mixtures thereof are used for neutralization, they include, but are not limited to acetic acid, hydrochloric acid, nitric acid, etc. To perform this, one of the above acids with a concentration of 1-100% is added into the reactor while vigorous mixing, except for hydrochloric acid, which, if used, is added with a concentration of 1-35%, while the pH of the reaction mass is maintained at the level of more than 0.5, preferably more than 1, further preferably more than 1.5 in order to avoid acid interaction with titanium metal.

In this case, the following reaction occurs:

$$zH_xAR+yCa(OH)_2=Ca_y(AR)_z+z*xH_2O \quad (24),$$

where, x varies from 1 to 3

AR is acid residue.

Neutralization is carried out according to pH; when the increase in pH of the reaction mass slows down to a level of less than +0.5 units per hour, neutralization is stopped.

Milling 304

The specified stage is carried out in a ball mill, where the reaction mass from the previous stage is pumped into. The milling chamber of a ball mill is a sealed drum made of titanium, including preferably CP Ti Grade 2 but not limited to it; said milling chamber is 25-85% filled with milling media. The milling media are made of titanium metal including but not limited to CP Grade 2; the milling media being balls with a diameter of 10 to 100 mm. Also, milling media can be shaped as cylinders with a cross-sectional diameter of cylinders ranging from 10 to 100 mm and a cylinder length ranging from 10 to 200 mm. In the ball mill, the reaction mass is milled to have 100% of particles sized less than 500 μm, preferably less than 250 μm, further preferably less than 160 μm. During milling, the pH of the reaction mass is maintained in the range of 0.5-7, preferably 1-6, further preferably 1.5-5. If the pH rises above normal, one of the above acids is introduced into the reaction mass.

Filtration and Washing 305

After milling 304, the resulting titanium metal slurry is filtered and washed with water to remove water-soluble impurities. Various types of filters can be used for filtration, they include but are not limited to drum vacuum filters, vacuum Nutsche filters, filter presses, candle filters, Moore vacuum filters, cartridge filters. The mother liquor containing dissolved reaction products and salts of the inert filler is sent for regeneration, where the said products are extracted for reuse and by-products are extracted for further sale.

The titanium powder or titanium alloy powder is washed until specific electrical conductivity of 10% slurry of titanium metal in water is less than 100 μS/cm, preferably less than 60 μS/cm, optimally less than 20 μS/cm.

Drying 306

Drying of the resulting powder is performed at temperatures of 30-150° C., preferably 40-130° C., optimally 50-90° C. at an absolute pressure ranging from 0.005 to 0.115 MPa, preferably from 0.010 to 0.090 MPa, further preferably from 0.015 to 0.080 MPa in air, argon, helium, nitrogen. The equipment may include, but is not limited to, spray dryers, vibration dryers, SWIRL FLUIDIZER (GEA) dryers, fluidized bed dryers, shelf dryers, drum dryers. The final moisture content of the powder after drying should not exceed 0.2%, and should preferably be less than 0.1%, further preferably less than 0.05%.

Classification 307

After drying, the obtained titanium metal powder is classified by size using one of the various types of classifiers including but not limited to vibrating screens, air (gas) classifiers. The classification is carried out in an inert gas environment such as argon, helium, nitrogen; gas humidity should have a dew point of less than −20° C., preferably less than −30° C., optimally less than −40° C., gas temperature being less than 80° C., preferably less than 60° C., optimally less than 40° C.

During the second step of reduction 308, to deoxidize the titanium alloy powder obtained after the first reduction step, neutralized and washed in accordance with the following description, calcium metal is used in accordance with Equation (1) in excess of 1-300%, preferably 5-80%, further preferably 10-30% of the calculated stoichiometric amount required for the reduction of the powder after the first step.

Dried titanium powder or titanium alloy powder obtained after the first reduction step 301, with oxygen content of 0.15-35%, preferably 2-20%, further preferably 5-10%, is sent to the second reduction step 308; the equipment being a crucible and a retort similar to those used during the first step 301.

Figure 6:
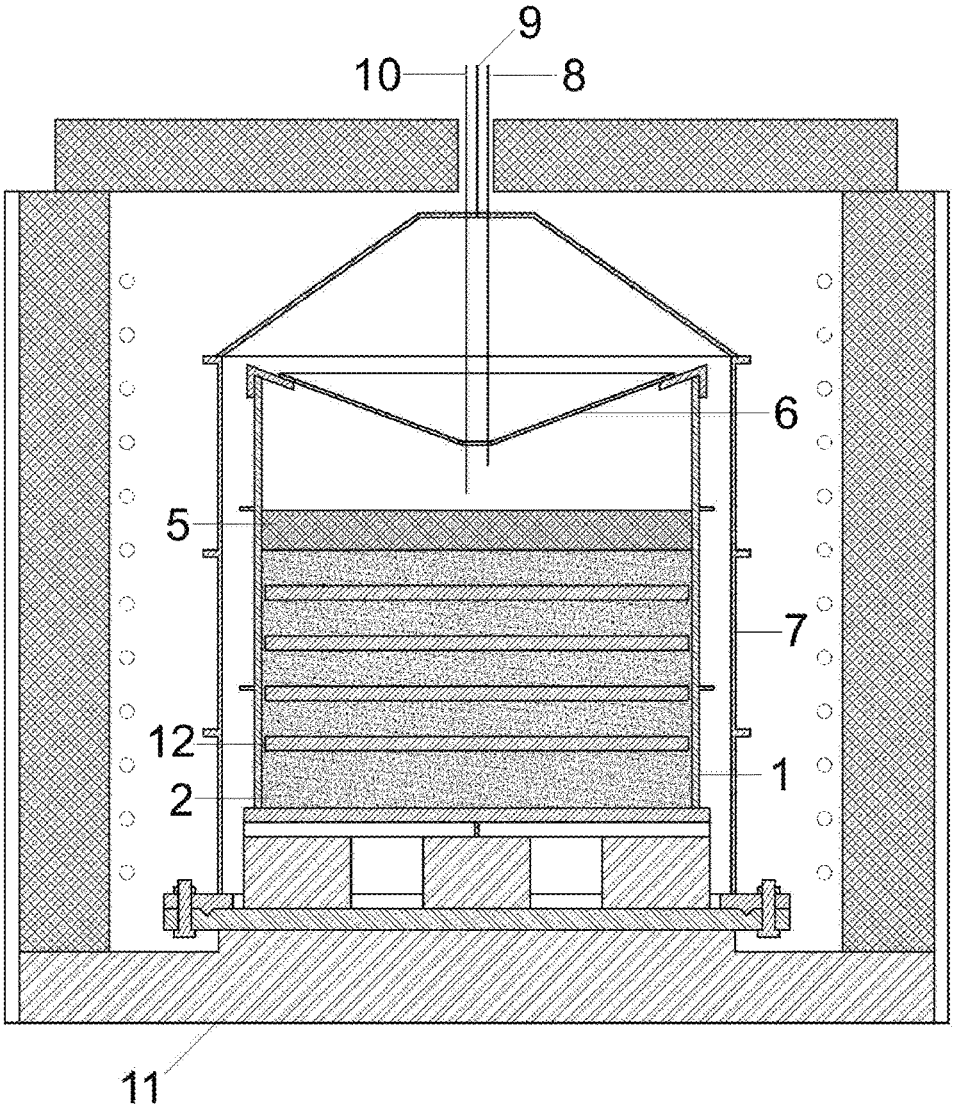
FIG. 6 shows a schematic illustration of the plant used for the reduction of feedstock elements in a two-step process.

As shown in FIG. 6, the loading of the crucible for the second reduction step 308 is carried out as follows: calcium metal as the reducing agent 2 is placed on the bottom of the crucible, and then a layer of the powder to be reduced 12 is placed on it, so that the mass ratio of the thickness of the reducing agent layer covering the bottom of the crucible to the powder to be reduced is in the range from 1:35 to 2:1. The thickness of the powder layer should be 1-20 mm, preferably 2-10 mm, further preferably 3-6 mm. Then, the layer of the powder to be reduced 12 is covered again by the layer of the reducing agent 2, similar to the first layer, which was placed on the bottom, and on top of it the layer of the powder to be reduced 12, similar to the layer of titanium powder on the bottom layer of the reducing agent, is placed. The total number of layers of the powder to be reduced placed on the layer of the reducing agent can be unlimited and is limited only by the height of the crucible used. The final top layer must always be the layer of the powder to be reduced 12.

It is possible, but not mandatory, to additionally use an inert filler, comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof. The inert filler is taken in the amount of 10-1000% of the feedstock elements weight, preferably 50-500%, optimally 75-200%. In such a case, the inert filler is loaded as the top layer after the main ingredients, namely the reducing agent and the powder to be reduced, have been loaded.

The heating of the retort and the reduction process are carried out according to the description provided above with regard to feedstock elements reduction 301 using calcium metal.

After cooling the retort, the flange bolted joint is disconnected and the crucible with the reacted mass is sent to the following stages: quenching 309, neutralizing 310, milling 311, washing to remove the reaction products formed, inert filler and residues of unreacted calcium and filtration 312, drying 313, classification 314 of the finished product 315.

The said stages are carried out in the same way as the stages of quenching 302, neutralizing 303, milling 304, washing to remove the reaction products formed, inert filler and residues of unreacted calcium and filtration 305, drying 306, classification 307 of the finished product, as has been described in detail above.

The chemical composition of the finished product 315 for specific embodiments of the proposed two-step method is shown in Table 3.

Figure 4:
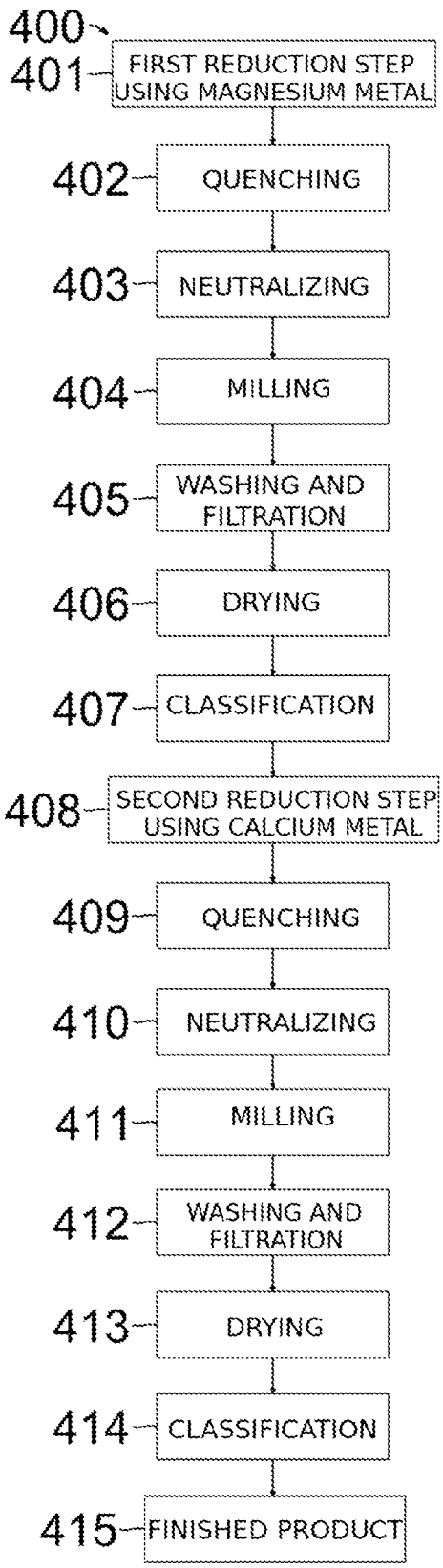
FIG. 4 shows an illustrative diagram of the two-step process for the reduction of feedstock elements using magnesium metal.

With reference to FIG. 4 which shows an illustrative diagram of a two-step process for the reduction of feedstock elements formed at Stage 110, a detailed description of the process is provided below. For the said process 400, the authors of the invention used magnesium metal as a reducing agent.

The parameters of the first reduction step 401 using magnesium metal are as follows:

The amount of magnesium metal as a reducing agent is calculated for the reduction of titanium oxide and for the reduction of dopant oxides dissolved in titanium oxide on a separate basis.

For titanium oxide reduction, the amount of magnesium metal is taken in the range from 20% deficiency to 50% excess with respect to the stoichiometric ratio according to Equation (10)

$$2Mg+TiO_2=Ti+2MgO \quad (10)$$

The reduction can proceed through a number of intermediate reactions described in Equations (11-17):

$$5TiO_2+Mg=Ti_4O_7+MgTiO_3 \quad (11)$$

$$Ti_4O_7+Mg=5Ti_3O_5+MgTiO_3 \quad (12)$$

$$3Ti_3O_5+Mg=4Ti_2O_3+MgTiO_3 \quad (13)$$

$$2Ti_2O_3+Mg=3TiO+MgTiO_3 \quad (14)$$

$$MgTiO_3+TiO=MgTi_2O_4 \quad (15)$$

$$MgTi_2O_4+Mg=2TiO+2MgO \quad (16)$$

$$TiO+Mg=Ti+MgO \quad (17).$$

To reduce the dopant oxide dissolved in titanium oxide crystal lattice to metal, magnesium metal is taken in the range from 20% deficiency to 50% excess with respect to the stoichiometric ratio according to Equation (18)

$$yMg+Me_xO_y=xMe+yMgO \quad (18).$$

The first step of the two-step reduction process 401 proceeds as follows. As shown in FIG. 5, a crucible 1 made of titanium, preferably of CP Ti Grade 2, is filled with 15-75% of the calculated amount of magnesium metal 2, comprising granules with the size of 0.1-30 mm, preferably 1-15 mm, optimally 2-10 mm. Magnesium metal can also be used in the form of lumps of 30-500 mm in size, preferably 50-400 mm, optimally 100-200 mm, or sheets with a thickness of 1 to 100 mm, a width of 30 to 1500 mm and a length of 30 to 1500 mm. Further, feedstock elements 3 are installed on the layer of magnesium metal 2 lying on the bottom of the crucible, so that the through holes in them are directed vertically, which ensures the free passage of magnesium vapors during the reduction process and their equal access to all surfaces of the feedstock elements.

After that, the remaining 25-85% of the calculated amount of magnesium metal (upper layer of magnesium 4) is loaded onto the surface of the feedstock elements 3 so that the upper part of the feedstock elements 3 is completely covered with magnesium metal. After that, an inert filler 5 is loaded onto the surface of magnesium metal 4; the inert filler comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof. The inert filler is taken in the amount of 10-1000% of the feedstock elements weight, preferably 50-500%, optimally 75-200%.

After loading all the components, the titanium crucible is covered with a titanium cover 6 and installed on the lower flange of the retort 7 with a gasket and covered with the cylindrical part of the retort. After that, the retort is sealed with a bolted joint (not shown). The retort has inlet nozzles for the inert gas 8 and evacuation 9, as well as a thermocouple 10. After the retort is sealed, a series of operations are performed to evacuate the retort and fill it with an inert gas, for example, argon or helium, to completely remove air residues from the retort, during 0.5-8 hours, preferably 1-6 hours, further preferably 2-4 hours. After the procedure to extract the remaining air is completed, the retort is left under an excess pressure of the inert gas throughout the reduction process to prevent air from entering the retort from the outside in case of the retort seal failure. It is possible to prepare the retort without the evacuation process; in this case the retort is purged with an inert gas, for which the inert gas discharge valve should be opened so that the remaining air is released from the inner part of the retort.

After the time controlled removal of the remaining air from the retort, the retort is transferred to the furnace 11, which can be but is not limited to a shaft- or tunnel-type furnace. An inert gas, such as nitrogen, argon, helium is continuously, during the reduction process, fed into the inner space of the furnace, where the heating elements are located, in order to avoid oxidation of the material of which the retort is made.

Furnace heating rate, the retort being placed in the furnace, is set at 1-6° C./min, preferably 2-5° C./min, optimally 3-4° C./min.

In case of using magnesium metal as a reducing agent the retort is heated in the following way: after heating the retort to a temperature of 650-800° C., preferably 670-770° C., optimally 680-750° C., heating is stopped and the first holding is performed for 0.5-8 hours, preferably 1-6 hours, optimally 2-4 hours. After the first holding time is over, the furnace temperature is raised at a rate described above to 820-1050° C., preferably 830-1020° C., optimally 850-950° C., and at this temperature the second holding is carried out for 1-48 hours, preferably 2-36 hours, optimally 4-24 hours. After the reduction time has elapsed, the retort is cooled to a temperature of 20-300° C., preferably 25-200° C., optimally 30-80° C., at a rate of 1-5° C./min, preferably 1-3° C./min, optimally 1.5-2° C./min.

After cooling the retort, the flange bolted joint is disconnected and the crucible with the reacted mass is sent to the following stages: quenching 402, neutralizing 403, milling 404, washing to remove the reaction products formed, inert filler and residues of unreacted calcium and filtration 405, drying 406, classification 407 of the product as described in detail below.

Quenching 402

The crucible with the reaction mass being a densely sintered mixture of titanium metal, magnesium oxides, the residues of magnesium metal and the inert filler, is placed in a reactor, which is filled with an inert gas, such as argon, helium or nitrogen, until air is completely removed from the reactor. After that, the reaction mass is poured with water with a temperature of 5 to 80° C., in a ratio ranging from 2:1 to 20:1 to the reaction mixture mass, and the quenching process is started. The reactor is agitated by, including but not limited to, mixers of various types and/or by pumping water and reaction products through the reactor using a pump. Soaking in water is carried out for 1-48 hours, preferably during 3-36 hours, further preferably during 6-12 hours.

At the quenching stage when using magnesium metal, the following chemical reactions take place:

$$MgO+H_2O=Mg(OH)_2 \quad (25)$$

$$Mg+2H_2O=Mg(OH)_2+2H \quad (26)$$

$$Mg+2H_2O=Mg(OH)_2+H_2 \quad (27)$$

$$Ti+2H=TiH_2 \quad (22)$$

$$Ti+H_2=TiH_2 \quad (23).$$

Reactions (22, 23) proceed slowly; accordingly, the amount of TiH2 formed is directly proportional to the time of the process of quenching in water: the longer the quenching time and the less intense the reactions (20, 21), the higher the $TiH_2$ content in the powder. Considering that the reaction of hydrogen insertion into particles is a heterophase reaction to insert a gaseous element into the solid phase, the distribution of hydrogen in the particles of a titanium metal alloy powder is not uniform and varies from a complete absence or minimal amounts in the central part of the particles, which is farthest from the surfaces, to maximum amounts closer to the surface and on the surface of the particles Hydrogenation of titanium powder surface or titanium alloy powder surface at this stage offers a certain advantage, since it protects titanium particles from oxidation by oxygen at the next stages of processing, and it also makes the powder of the finished titanium or its alloys less pyrophoric, that is, less prone to spontaneous combustion. During subsequent processing into finished products, hydrogen can be removed from titanium products and titanium alloys to the required values by high-temperature annealing.

During this stage, the ingress of air into the reactor is prevented, and the gaseous hydrogen formed during the reaction is removed from the reactor and disposed of in accordance with safety and environment protection requirements.

Neutralizing 403

After the quenching 402 is completed, the reaction mixture is neutralized. Various organic and inorganic acids and mixtures thereof are used for neutralization, they can include, for example, but are not limited to acetic acid, hydrochloric acid, nitric acid, etc. To perform this, one of the above acids with a concentration of 1-100% is added into the reactor while vigorous mixing, except for hydrochloric acid, which, if used, is added with a concentration of 1-35%, while the pH of the reaction mass is maintained at the level of more than 0.5, preferably more than 1, further preferably more than 1.5 in order to avoid acid interaction with titanium metal.

In this case, the following reaction occurs:

$$zH_xAR+yMg(OH)_2=Mg_y(AR)_z+z*xH_2O \quad (28)$$

where, x varies from 1 to 3

AR is acid residue.

Neutralization is carried out according to pH; when the increase in pH of the reaction mass slows down to a level of less than +0.5 units per hour, neutralization is stopped.

Milling 404

The specified stage is carried out in a ball mill, where the reaction mass from the previous stage is pumped into. The milling chamber of a ball mill is a sealed drum made of titanium, including preferably CP Ti Grade 2 but not limited to it; said milling chamber is 25-85% filled with milling media. The milling media are made of titanium metal including but not limited to CP Grade 2; the milling media being balls with a diameter of 10 to 100 mm. Also, milling media can be shaped as cylinders with a cross-sectional diameter of cylinders ranging from 10 to 100 mm and a cylinder length ranging from 10 to 200 mm. In the ball mill, the reaction mass is milled to have 100% of particles sized less than 500 μm, preferably less than 250 μm, further preferably less than 160 μm. During milling, the pH of the reaction mass is maintained in the range of 0.5-7, preferably 1-6, further preferably 1.5-5. If the pH rises above normal, one of the above acids is introduced into the reaction mass.

Filtration and Washing 405

After milling 404, the resulting titanium metal slurry is filtered and washed with water to remove water-soluble impurities. Various types of filters can be used for filtration, they include but are not limited to drum vacuum filters, vacuum Nutsche filters, filter presses, candle filters, Moore vacuum filters, cartridge filters. The mother liquor containing dissolved reaction products and salts of the inert filler is sent for regeneration, where the said products are extracted for reuse and by-products are extracted for further sale.

The titanium powder or titanium alloy powder is washed until specific electrical conductivity of 10% slurry of titanium metal in water is less than 100 μS/cm, preferably less than 60 μS/cm, optimally less than 20 μS/cm.

Drying 406

Drying of the resulting powder is performed at temperatures of 30-150° C., preferably 40-130° C., optimally 50-90° C. at an absolute pressure ranging from 0.005 to 0.115 MPa, preferably from 0.010 to 0.090 MPa, further preferably from 0.015 to 0.080 MPa in air, argon, helium, nitrogen. The equipment may include, but is not limited to, spray dryers, vibration dryers, SWIRL FLUIDIZER (GEA) dryers, fluidized bed dryers, shelf dryers, drum dryers. The final moisture content of the powder after drying should not exceed 0.2%, and should preferably be less than 0.1%, further preferably less than 0.05%.

Classification 407

After drying, the obtained titanium metal powder is classified by size using one of the various types of classifiers including but not limited to vibrating screens, air (gas) classifiers. The classification is carried out in an inert gas environment such as argon, helium, nitrogen; gas humidity should have a dew point of less than −20° C., preferably less than −30° C., optimally less than −40° C., gas temperature being less than 80° C., preferably less than 60° C., optimally less than 40° C.

During the second reduction step 408, to deoxidize the titanium alloy powder obtained after the first reduction step, neutralized and washed in accordance with the following description, calcium metal is used in accordance with Equation (1) in excess of 1-300%, preferably 5-80%, further preferably 10-30% of the calculated stoichiometric amount required for the reduction of the powder after the first step.

Dried titanium powder or titanium alloy powder obtained after the first reduction step 401, with oxygen content of 0.15-35%, preferably 2-20%, further preferably 5-10%, is sent to the second reduction step 408; the equipment being a crucible and a retort similar to those used during the first step 401.

As shown in FIG. 6, the loading of the crucible for the second reduction step 408 is carried out as follows: calcium metal as the reducing agent 2 is placed on the bottom of the crucible, and then a layer of the powder to be reduced 12 is placed on it, so that the mass ratio of the thickness of the reducing agent layer covering the bottom of the crucible to the powder to be reduced is in the range from 1:35 to 2:1. The thickness of the powder layer should be 1-20 mm, preferably 2-10 mm, further preferably 3-6 mm. Then, the layer of the powder to be reduced 12 is covered again by the layer of the reducing agent 2, similar to the first layer, which was placed on the bottom, and on top of it the layer of the powder to be reduced 12, similar to the layer of titanium powder on the bottom layer of the reducing agent, is placed. The total number of layers of the powder to be reduced placed on the layer of the reducing agent can be unlimited and is limited only by the height of the crucible used. The final top layer must always be the layer of the powder to be reduced 12.

It is possible, but not mandatory, to additionally use an inert filler, comprising metal halides of Groups 1-2 of the Periodic Table or their mixtures in various proportions including, for example, calcium chloride ($CaCl_2$), potassium chloride (KCl), magnesium chloride ($MgCl_2$), sodium chloride (NaCl), but not limited to these salts or mixtures thereof. The inert filler is taken in the amount of 10-1000% of the feedstock elements weight, preferably 50-500%, optimally 75-200%. In such a case, the inert filler is loaded as the top layer after the main ingredients, namely the reducing agent and the powder to be reduced, have been loaded.

The heating of the retort and the reduction process are carried out according to the description provided above with regard to feedstock elements reduction 401 using magnesium metal.

After cooling the retort, the flange bolted joint is disconnected and the crucible with the reacted mass is sent to the following stages: quenching 409, neutralizing 410, milling 411, washing to remove the reaction products formed, inert filler and residues of unreacted calcium and filtration 412, drying 413, classification 414 of the finished product 415.

The said stages are carried out in the same way as the stages of quenching 402, neutralizing 403, milling 404, washing to remove the reaction products formed, inert filler and residues of unreacted calcium and filtration 405, drying 406, classification 407 of the finished product, as has been described in detail above.

The chemical composition of the finished product 415 for specific embodiments of the proposed two-step method is shown in Table 3.

Below are the examples of the technical solution of the present invention, by which it is illustrated, including but not limited to them.

EXAMPLE 1

2000 l of filtered $TiOCl_2$ solution with $TiO_2$ concentration of 100 g/l and $Ti^{3+}$0.5 g/l content with a temperature of 40° C. is fed into the hydrolysis reactor, where it is heated up to 90° C. within 10 minutes. After that, the solution is heated for 10 minutes to a boiling point of 103° C. and boiled for 3 hours, the pressure in the hydrolysis reactor is kept at the range of 0.09-0.11 MPa. The vapors of hydrochloric acid evolved during this process are removed from the hydrolysis reactor through a heat exchanger irrigated with chilled water having a temperature of +7° C., where the condensation of hydrochloric acid with 35% HCl content takes place. The hydrochloric acid solution is continuously withdrawn from the refrigerator and collected in a separate collecting tank. Subsequently, hydrochloric acid can be used to obtain a $TiOCl_2$ solution or for neutralization after reduction at the next stages of the process. The yield of precipitation of titanium oxides and hydroxides expressed in terms of $TiO_2$ is 99.5%. The average particle size of the resulting titanium oxide/hydroxide, determined by laser diffraction (Mastersizer 3000), is 5 μm, the smallest particles are 1 μm, the largest particles are 10.5 μm (determined using the scanning electron microscope Tescan Mira 3 LMU). The resulting precipitate of titanium oxides/hydroxides is filtered in a candle filter and washed with 2.5 $m^3$ of demineralized water with a specific electrical conductivity of 60 μS/cm.

Washed titanium oxide/hydroxide in the amount of 200 kg in terms of $TiO_2$ is dispersed in the precipitation reactor with demineralized water up to $TiO_2$ concentration of 350 g/l, after which pH of the suspension is adjusted with sodium hydroxide to 10.5 and thoroughly mixed for 30 minutes. After that, with vigorous stirring of the reaction mass, 300 liters of sodium aluminate with $Al_2O_3$ content of 50 g/l are fed into the precipitation reactor at the rate of 15 liters per minute and are kept for 10 minutes. After that, 633 liters of ammonium metavanadate solution with $V2O_5$ content of 16 g/l are fed into the precipitation reactor at a rate of 30 liters per minute and are kept for 10 minutes. After that, pH of the reaction mass is adjusted to pH=7 using a 5% solution of hydrochloric acid, then the reaction mass is heated up to 50° C. and kept for 1 hour. In this case, there is a uniform precipitation of oxides and/or hydroxides of aluminum and vanadium in the entire volume of the reaction mass, which ensures their maximum distribution on the surface of particles of oxides/hydroxides of titanium. After that, the resulting reaction mass is sent for filtration using a filter press to remove the mother liquor and wash out water-soluble salts.

The cake of titanium oxides/hydroxides (with uniformly precipitated aluminum and vanadium oxides/hydroxides) squeezed out using filter press is fed for calcination to the rotary drum calciner, heated by electric heating elements. The reaction mass is gradually heated up to 1000° C., and at the first stage of heating, free moisture is removed from it, then, as it is heated further, crystalline bound moisture is removed from it, and the transformation of hydroxides into oxides occurs. After the reaction mass reaches a temperature of 1000° C., it is kept for 3 hours to ensure the dissolution of the formed aluminum and vanadium oxides in the crystal lattice of titanium oxide. After holding at 1000° C., the reaction mass is cooled and, after cooling, subjected to grinding using a centrifugal mill. The efficiency of dissolution of vanadium and aluminum oxides in titanium oxide is monitored as follows: using XRF Rigaku Supermini 200 device, the content of Al and V elements in the obtained sample after calcination is analyzed. Then, the sample of a solid solution of aluminum and vanadium in titanium oxide obtained after calcination is dissolved in boiling concentrated sulfuric acid so that 50-70% by weight of the sample is dissolved, then the insoluble precipitate in the amount of 30-50% by weight from the original sample is filtered off, washed out of sulfuric acid and analyzed by XRF. The results of the content of Al and V in the residue differ from the results of the content of Al and V in the sample not subjected to dissolution in sulfuric acid by less than 5%, which indicates the dissolution of alloying additives in the crystal lattice of titanium oxide and a uniform distribution of alloying additives Al and V in the entire volume of titanium oxide particles (the results are shown in Table 1).

After grinding from titanium oxide powder with alloying additives dissolved in it, the raw elements are formed by extrusion, for that the carboxymethyl cellulose is added to the powder in the amount of 7% of the powder weight, the water is added in the amount of 10% of the powder weight, and the resulting mass is mixed thoroughly using the extruder and is poured to make the hollow cylindrical castings with an outer diameter of 30 mm, a wall thickness of 5 mm, and a length of 450 mm. The resulting castings are dried to constant weight at temperature of 120° C. and then calcined at temperature of 1000° C. for 3 hours. After that, the raw elements are cooled. The porosity of the raw elements obtained is 55%, the strength is 16 kg/$cm^2$.

The metallic calcium in the amount of 50 kg is loaded into the crucible made of metallic titanium (material—titanium Grade 2). The metallic calcium is in the form of granules with diameter of 2 up to 6 mm. The raw elements in the amount of 224.5 kg are installed on this layer of calcium in such a way that the through holes in them are directed vertically, while the raw elements are installed one to the other in such a way that they are tightly pressed against one another, and also tightly pressed against the walls of the crucible. After that, 230 kg of metallic calcium are filled up onto the layer of raw materials. After that, 224.5 kg of dehydrated calcium chloride are filled up. The crucible is covered with a lid and placed in a retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed into the kiln and heated up to 900° C. at the rate of 4° C. per minute. During the entire process, the argon pressure in the retort is kept at the range of 0.11-0.2 MPa. Upon reaching 900° C., the holding up is made at this temperature for 4 hours. After that, the temperature in the kiln is raised up to 1000° C. at the rate of 4° C. per minute. Upon reaching the temperature of 1000° C., the holding up is made for 20 hours. After that, the retort is cooled to 30° C. at the rate of 5° C. per minute. When the temperature in the kiln reaches 30° C., the retort is removed from the kiln, depressurization is performed, and the crucible is removed from the retort. A visual inspection of the raw elements indicates that they retained their original shape and were not subject to destruction, although they slightly increased in size due to the saturation of the pores with calcium oxide, also the raw elements are located in the retort at the level at which they were originally installed, under them in place where there was the metallic calcium, a void was formed, filled from below with a molten calcium chloride. No traces of condensation of metallic calcium or traces of calcium oxide were found on the walls and bottom of the retort, this fact indicates the absence of transfer of the reducing agent from the crucible and the most efficient use of the reducing agent for the reduction reaction of raw elements.

The crucible with the reaction mass, which is the densely sintered mixture of metallic titanium, calcium oxide, residual metallic calcium and calcium chloride, is placed in a special reactor, which is blown out with nitrogen until air is completely removed from the reactor. After that, the reaction mass is poured with water, having the temperature of 20° C., in the amount of 3000 liters, and the quenching process begins. Stirring in the reactor is ensured by pumping the reaction mass from the reactor and again back into the reactor at the rate of 5 $m^3$/h with a circulation pump. The time for this operation is 3 hours. After that, hydrochloric acid with HCl content of 30% is fed into the reactor with the circulating pump running, while the acid feed rate is controlled by controlling pH of the reaction mass at the level of 1.2. When pH drops to 0.7 and this value is stabilized within 1 hour, the neutralization operation is stopped. After that, the reaction mass is pumped into a ball mill, the grinding chamber of which is a sealed drum made of CP Grade 2 titanium, filled up to 50% with grinding media. The grinding media are made of CP Grade 2 titanium metal and are balls of different diameters from 10 to 50 mm. In the ball mill, the reaction mass is milled up to 100% of particle sizes less than 160 microns. During milling, pH of the reaction mass is maintained in the range of 1.2. If pH rises above the norm, 30% hydrochloric acid solution is introduced into the reaction mass to adjust the acidity to pH=1.2. After the grinding stage, the resulting suspension of titanium metal is filtered and washed with water out of the water-soluble impurities using candle filters. The mother liquor containing dissolved calcium chloride is sent to the regeneration stage, where calcium chloride is recovered for reuse, as well as for further commercialization as a finished product (for example, as an anti-icing additive, etc.). The powder of titanium alloys is washed until the specific electrical conductivity of 10% suspension of metallic titanium in water is less than 30 μS/cm.

After washing, the obtained cake of titanium metal powder is dried at temperature of 60° C. and at the absolute pressure of 0.015 MPa in argon atmosphere. The equipment used is Memmert VO101 vacuum dryer, the drying time is 4 hours, the final moisture content of the powder after drying is 0.01%. After drying, the powder is classified by size on the sieve less than 160 microns. The classification is carried out in argon atmosphere.

As a result, 133.33 kg of titanium powder alloy was obtained, similar in chemical composition to Grade 5 according to ASTM B 348-09, but with some excess in oxygen content, the characteristics of the obtained titanium powder alloy are presented in Table 3.

EXAMPLE 2

The same procedure and sequence of actions are used as in example 1, except for the hydrolysis stage, which is described below. 2000 1 of filtered $TiOCl_2$ solution with $TiO_2$ concentration of 100 g/l and $Ti^{3+}$ 0.5 g/l content with a temperature of 40° C. is fed into a 100 1 hydrolysis reactor, where it is heated up to 90° C. within 50 minutes, after which hydrolysis begins. After that, the solution is heated within 25 minutes to a boiling point of 107° C. and boiled for 5.5 hours, the pressure in the hydrolysis reactor is kept at the range of 0.09-0.13 MPa. The vapors of hydrochloric acid evolved during this process are removed from the hydrolysis reactor through a heat exchanger irrigated with chilled water having a temperature of +7° C., where the condensation of hydrochloric acid with 35% HCl content takes place. The hydrochloric acid solution is continuously withdrawn from the refrigerator and collected in a separate collecting tank. Subsequently, hydrochloric acid can be used to obtain a $TiOCl_2$ solution or to leach calcium or magnesium oxides after reduction at the next stages of the process. The yield of precipitation of titanium oxides and hydroxides expressed in terms of $TiO_2$ is 99.5%. The average particle size of the resulting titanium oxide/hydroxide, determined by laser diffraction (Mastersizer 3000), is 18.5 μm, the smallest particles are 10 μm, the largest particles are 30 μm (determined using the scanning electron microscope Tescan Mira 3 LMU). The resulting precipitate of titanium oxides/hydroxides is filtered in a candle filter and washed with 1.2 $m^3$ of demineralized water with a specific electrical conductivity of 60 μS/cm.

For all other stages, the same procedure is used as described in example 1.

According to the procedure described in example 1, the efficiency of the distribution of alloying additions in the crystal lattice of titanium oxide is checked after the stage of calcining the cake of oxides/hydroxides of titanium with uniformly precipitated oxides/hydroxides of alloying additives. The results of the content of Al and V in the residue differ from the results of the content of Al and V in the sample not subjected to dissolution in sulfuric acid by less than 5%, which indicates the dissolution of alloying additives in the crystal lattice of titanium oxide and a uniform distribution of alloying additives Al and V in the entire volume of titanium oxide particles (the results are shown in Table 1).

As a result, 133.29 kg of titanium powder alloy were obtained, similar in chemical composition to Grade 5 according to ASTM B 348-09, the characteristics of the obtained titanium powder alloy are presented in Table 3.

EXAMPLE 3

Prior to the reduction stage, the same procedure and sequence of actions are used as in example 2, except for the reduction stage, which is carried out in two stages and is described below.

According to the procedure described in example 1, the efficiency of the distribution of alloying additions in the crystal lattice of titanium oxide is checked after the stage of calcining the cake of oxides/hydroxides of titanium with uniformly precipitated oxides/hydroxides of alloying additives. The results of the content of Al and V in the residue differ from the results of the content of Al and V in the sample not subjected to dissolution in sulfuric acid by less than 5%, which indicates the dissolution of alloying additives in the crystal lattice of titanium oxide and a uniform distribution of alloying additives Al and V in the entire volume of titanium oxide particles (the results are shown in Table 1).

The first stage of reduction is carried out using metallic magnesium as a reducing agent; the second stage of reduction is carried out using metallic calcium as a reducing agent.

The metallic magnesium in the amount of 25 kg is loaded into the crucible made of metallic titanium (material— titanium Grade 2). The metallic magnesium is in the form of granules with diameter of 2 up to 6 mm. The raw elements in the amount of 224.5 kg are installed on this layer of magnesium in such a way that the through holes in them are directed vertically, while the raw elements are installed one to the other in such a way that they are tightly pressed against one another, and also tightly pressed against the walls of the crucible. After that, 105 kg of metallic magnesium are filled up onto the layer of raw materials. After that, 70 kg of dehydrated calcium chloride are filled up. The crucible is covered with a lid and placed in a retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed into the kiln and heated up to 750° C. at the rate of 4° C. per minute. Upon reaching 750° C., the holding up is made at this temperature for 15 hours. After that, the temperature in the kiln is raised up to 1000° C. at the rate of 4° C. per minute. Upon reaching the temperature of 1000° C., the holding up is made for 10 hours. After that, the retort is cooled to 30° C. at the rate of 5° C. per minute. When the temperature in the kiln reaches 30° C., the retort is removed from the kiln, depressurization is performed, and the crucible is removed from the retort. A visual inspection of the raw elements indicates that they retained their original shape and were not subject to destruction, although they slightly increased in size due to the saturation of the pores with magnesium oxide, also the raw elements are located in the retort at the level at which they were originally installed, under them in place where there was the metallic magnesium, a void was formed, filled from below with a molten calcium chloride. No traces of condensation of metallic magnesium or traces of magnesium oxide were found on the walls and bottom of the retort, this fact indicates the absence of transfer of the reducing agent from the crucible and the most efficient use of the reducing agent for the reduction reaction of raw elements.

The crucible with the reaction mass, which is the densely sintered mixture of metallic titanium, magnesium oxide, residual metallic magnesium and calcium chloride, is placed in a special reactor, which is blown out with nitrogen until air is completely removed from the reactor. After that, the reaction mass is poured with water, having the temperature of 20° C., in the amount of 750 liters, and the quenching process begins. Stirring in the reactor is ensured by pumping the reaction mass from the reactor and again back into the reactor at the rate of 5 $m^3/h$ with a circulation pump. The time for this operation is 3 hours. After that, hydrochloric acid with HCl content of 30% is fed into the reactor with the circulating pump running, while the acid feed rate is controlled by controlling pH of the reaction mass at the level of 1.2. When pH drops to 0.7 and this value is stabilized within 1 hour, the neutralization operation is stopped. After that, the reaction mass is pumped into a ball mill, the grinding chamber of which is a sealed drum made of CP Grade 2 titanium, filled up to 50% with grinding media. The grinding media are made of CP Grade 2 titanium metal and are balls of different diameters from 10 to 50 mm. In the ball mill, the reaction mass is milled up to 100% of particle sizes less than 160 microns. During milling, pH of the reaction mass is maintained in the range of 1.2. If pH rises above the norm, 30% hydrochloric acid solution is introduced into the reaction mass to adjust the acidity to pH=1.2. After the grinding stage, the resulting suspension of titanium metal is filtered and washed with water out of the water-soluble impurities using candle filters. The mother liquor containing dissolved magnesium chloride and calcium chloride is sent to the regeneration stage, where calcium chloride and magnesium chloride are extracted, calcium chloride can be reused, as well as for further commercial sales as a finished product (for example, as an anti-icing additive etc.), magnesium chloride used commercially. The powder of titanium alloys is washed until the specific electrical conductivity of 10% suspension of metallic titanium in water is less than 30 μS/cm.

After washing, the obtained cake of powder of metallic titanium after the first stage of reduction is subjected to drying at temperatures of 60° C. at the absolute pressure of 0.015 MPa in argon atmosphere. The equipment used is Memmert VO101 vacuum dryer, drying time is 4 hours, the final moisture content of the powder after drying is 0.01%. After drying, the powder is classified by size on a sieve less than 160 microns. The classification is carried out in argon atmosphere. The resulting powder is analyzed for oxygen content to calculate the amount of the reducing agent in the second stage of reduction. The results of the oxygen content in the obtained powder are presented in Table 2.

The metallic calcium in the amount of 5 kg is loaded into the crucible made of metallic titanium (material—titanium Grade 2). The metallic calcium is in the form of granules with diameter of 2 up to 6 mm. Then, 4-6 mm thick layer of powder obtained after the first stage of reduction is loaded onto this layer, then 2-6 mm thick layer of metallic calcium is loaded onto the layer of powder, then again a layer of powder obtained after the first stage of reduction and again a layer of metallic calcium and so on until a full load of 145.7 kg of powder and 38.7 kg of metallic calcium (taking into account the 5 kg loaded at the beginning). The final top layer consists of reducible powder. The crucible is covered with the lid and installed in the retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed in the kiln and heated to 900° C. at the rate of 4° C. per minute. Upon reaching 900° C., the holding up is made at this temperature for 4 hours. After that, the temperature in the kiln is raised up to 1000° C. at the rate of 4° C. per minute. Upon reaching the temperature of 1000° C., the holding up is made for 20 hours. After that, the retort is cooled to 30° C. at the rate of 5° C. per minute. When the temperature in the kiln reaches 30° C., the retort is removed from the kiln, depressurization is performed, and the crucible is removed from the retort.

The crucible with the reaction mass, which is the densely sintered mixture of metallic titanium, calcium oxide and residual metallic calcium, is placed in a special reactor, which is blown out with nitrogen until air is completely removed from the reactor. After that, the reaction mass is poured with water, having the temperature of 20° C., in the amount of 750 liters, and the quenching process begins. Stirring in the reactor is ensured by pumping the reaction mass from the reactor and again back into the reactor at the rate of 5 $m^3/h$ with a circulation pump. The time for this operation is 3 hours. After that, hydrochloric acid with HCl content of 30% is fed into the reactor with the circulating pump running, while the acid feed rate is controlled by controlling pH of the reaction mass at the level of 1.2. When pH drops to 0.7 and this value is stabilized within 1 hour, the neutralization operation is stopped. After that, the reaction mass is pumped into a ball mill, the grinding chamber of which is a sealed drum made of CP Grade 2 titanium, filled up to 50% with grinding media. The grinding media are made of CP Grade 2 titanium metal and are balls of different diameters from 10 to 50 mm. In the ball mill, the reaction mass is milled up to 100% of particle sizes less than 160 microns. During milling, pH of the reaction mass is maintained in the range of 1.2. If pH rises above the norm, 30% hydrochloric acid solution is introduced into the reaction mass to adjust the acidity to pH=1.2. After the grinding stage, the resulting suspension of titanium metal is filtered and washed with water out of the water-soluble impurities using candle filters. The mother liquor containing dissolved calcium chloride is sent to the regeneration stage, where calcium chloride is recovered for reuse, as well as for further commercialization as a finished product (for example, as an anti-icing additive, etc.). The powder of titanium alloys is washed until the specific electrical conductivity of 10% suspension of metallic titanium in water is less than 30 μS/cm.

In the subsequent stages of drying and classification, the same procedure and sequence of actions are used as in example 2.

As a result, 133.17 kg of titanium powder alloy was obtained, similar in chemical composition to Grade 5 according to ASTM B 348-09, the characteristics of the obtained titanium powder alloy are presented in Table 3.

EXAMPLE 4

Prior to the reduction stage, the same procedure and sequence of actions are used as in example 3, except for the reduction stage, which is carried out in two stages and is described below.

According to the procedure described in example 1, the efficiency of the distribution of alloying additions in the crystal lattice of titanium oxide is checked after the stage of calcining the cake of oxides/hydroxides of titanium with uniformly precipitated oxides/hydroxides of alloying additives. The results of the content of Al and V in the residue differ from the results of the content of Al and V in the sample not subjected to dissolution in sulfuric acid by less than 5%, which indicates the dissolution of alloying additives in the crystal lattice of titanium oxide and a uniform distribution of alloying additives Al and V in the entire volume of titanium oxide particles (the results are shown in Table 1).

The first stage of reduction is carried out using metallic calcium as a reducing agent; the second stage of reduction is carried out using metallic calcium as a reducing agent.

The metallic calcium in the amount of 50 kg is loaded into the crucible made of metallic titanium (material—titanium Grade 2). The metallic calcium is in the form of granules with diameter of 2 up to 6 mm. The raw elements in the amount of 224.5 kg are installed on this layer of calcium in such a way that the through holes in them are directed vertically, while the raw elements are installed one to the other in such a way that they are tightly pressed against one another, and also tightly pressed against the walls of the crucible. After that, 163,3 kg of metallic calcium are filled up onto the layer of raw materials. After that, 70 kg of dehydrated calcium chloride are filled up. The crucible is covered with a lid and placed in a retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed into the kiln and heated up to 900° C. at the rate of 4° C. per minute. Upon reaching 900° C., the holding up is made at this temperature for 4 hours. After that, the temperature in the kiln is raised up to 1000° C. at the rate of 4° C. per minute. Upon reaching the temperature of 1000° C., the holding up is made for 10 hours. After that, the retort is cooled to 30° C. at the rate of 5° C. per minute. When the temperature in the kiln reaches 30° C., the retort is removed from the kiln, depressurization is performed, and the crucible is removed from the retort. A visual inspection of the raw elements indicates that they retained their original shape and were not subject to destruction, although they slightly increased in size due to the saturation of the pores with calcium oxide, also the raw elements were located in the retort at the level at which they were originally installed, under them in place where there was the metallic calcium, a void was formed, filled from below with a molten calcium chloride. No traces of condensation of metallic calcium or traces of calcium oxide were found on the walls and bottom of the retort, this fact indicates the absence of transfer of the reducing agent from the crucible and the most efficient use of the reducing agent for the reduction reaction of raw elements.

The crucible with the reaction mass, which is the densely sintered mixture of metallic titanium, calcium oxide, residual metallic calcium and calcium chloride, is placed in a special reactor, which is blown out with nitrogen until air is completely removed from the reactor. After that, the reaction mass is poured with water, having the temperature of 20° C., in the amount of 3000 liters, and the quenching process begins. Stirring in the reactor is ensured by pumping the reaction mass from the reactor and again back into the reactor at the rate of 5 $m^3$/h with a circulation pump. The time for this operation is 3 hours. After that, hydrochloric acid with HCl content of 30% is fed into the reactor with the circulating pump running, while the acid feed rate is controlled by controlling pH of the reaction mass at the level of 1.2. When pH drops to 0.7 and this value is stabilized within 1 hour, the neutralization operation is stopped. After that, the reaction mass is pumped into a ball mill, the grinding chamber of which is a sealed drum made of CP Grade 2 titanium, filled up to 50% with grinding media. The grinding media are made of CP Grade 2 titanium metal and are balls of different diameters from 10 to 50 mm. In the ball mill, the reaction mass is milled up to 100% of particle sizes less than 160 microns. During milling, pH of the reaction mass is maintained in the range of 1.2. If pH rises above the norm, 30% hydrochloric acid solution is introduced into the reaction mass to adjust the acidity to pH=1.2. After the grinding stage, the resulting suspension of titanium metal is filtered and washed with water out of the water-soluble impurities using candle filters. The mother liquor containing dissolved calcium chloride is sent to the regeneration stage, where calcium chloride is recovered for reuse, as well as for further commercialization as a finished product (for example, as an anti-icing additive, etc.). The powder of titanium alloys is washed until the specific electrical conductivity of 10% suspension of metallic titanium in water is less than 30 μS/cm.

After washing, the obtained cake of powder of metallic titanium after the first stage of reduction is subjected to drying at temperatures of 60° C. at the absolute pressure of 0.015 MPa in argon atmosphere. The equipment used is Memmert VO101 vacuum dryer, drying time is 4 hours, the final moisture content of the powder after drying is 0.01%. After drying, the powder is classified by size on a sieve less than 160 microns. The classification is carried out in argon atmosphere. The resulting powder is analyzed for oxygen content to calculate the amount of the reducing agent in the second stage of reduction. The results of the oxygen content in the obtained powder are presented in Table 2.

The metallic calcium in the amount of 5 kg is loaded into the crucible made of metallic titanium (material—titanium Grade 2). The metallic calcium is in the form of granules with diameter of 2 up to 6 mm. Then, 4-6 mm thick layer of powder obtained after the first stage of reduction is loaded onto this layer, then 2-6 mm thick layer of metallic calcium is loaded onto the layer of powder, then again a layer of powder obtained after the first stage of reduction and again a layer of metallic calcium and so on until a full load of 141.4 kg of powder and 24.4 kg of metallic calcium (taking into account the 5 kg loaded at the beginning). The final top layer consists of reducible powder. The crucible is covered with the lid and installed in the retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed in the kiln and heated to 900° C. at the rate of 4° C. per minute. Upon reaching 900° C., the holding up is made at this temperature for 4 hours. After that, the temperature in the kiln is raised up to 1000° C. at the rate of 4° C. per minute. Upon reaching the temperature of 1000° C., the holding up is made for 20 hours. After that, the retort is cooled to 30° C. at the rate of 5° C. per minute. When the temperature in the kiln reaches 30° C., the retort is removed from the kiln, depressurization is performed, and the crucible is removed from the retort.

In the subsequent stages of quenching, neutralization, grinding, washing, drying and classification, the same procedure and sequence of actions is used as in example 3.

As a result, 133.11 kg of titanium powder alloy was obtained, similar in chemical composition to Grade 23 according to ASTM B 348-09, the characteristics of the obtained titanium powder alloy are presented in Table 3.

EXAMPLE 5

Prior to the stage of manufacturing the raw elements, the same procedure and sequence of actions are used as in example 4, except for the stage of manufacturing the raw elements, as well as the second stage of reduction, which are described below.

According to the procedure described in example 1, the efficiency of the distribution of alloying additions in the crystal lattice of titanium oxide is checked after the stage of calcining the cake of oxides/hydroxides of titanium with uniformly precipitated oxides/hydroxides of alloying additives. The results of the content of Al and V in the residue differ from the results of the content of Al and V in the sample not subjected to dissolution in sulfuric acid by less than 5%, which indicates the dissolution of alloying additives in the crystal lattice of titanium oxide and a uniform distribution of alloying additives Al and V in the entire volume of titanium oxide particles (the results are shown in Table 1).

After grinding from titanium oxide powder with alloying additives dissolved in it, the raw elements are formed by extrusion, for that the carboxymethyl cellulose is added to the powder in the amount of 14% of the powder weight, the water is added in the amount of 15% of the powder weight, and the resulting mass is mixed thoroughly using the extruder and is poured to make the hollow cylindrical castings with an outer diameter of 30 mm, a wall thickness of 5 mm, and a length of 450 mm. The resulting castings are dried to constant weight at temperature of 120° C. and then calcined at temperature of 1000° C. for 3 hours. After that, the raw elements are cooled. The porosity of the raw elements obtained is 65%, the strength is 11 kg/cm$^2$.

In the further steps of the first and second stages of reduction, quenching, neutralization, grinding, washing, drying and classification, the same procedure and sequence of actions are used as in example 4. After the first stage of reduction, a visual inspection of the raw elements was carried out, it was found that about 5-7% of the raw elements were destroyed; in general, all raw elements slightly increased in size due to the saturation of the pores with calcium oxide, the raw elements were located in the retort at the level at which they were originally installed, under them in place where there was the metallic calcium, a void was formed, filled from below with a molten calcium chloride. No traces of condensation of metallic calcium or traces of calcium oxide were found on the walls and bottom of the retort, this fact indicates the absence of transfer of the reducing agent from the crucible and the most efficient use of the reducing agent for the reduction reaction of raw elements.

The powder obtained after the first stage of reduction, ground and washed and dried, is analyzed for oxygen content to calculate the amount of the reducing agent in the second stage of reduction. The results of the oxygen content in the obtained powder are presented in Table 2.

The metallic calcium in the amount of 5 kg is loaded into the crucible made of metallic titanium (material—titanium Grade 2). The metallic calcium is in the form of granules with diameter of 2 up to 6 mm. Then, 4-6 mm thick layer of powder obtained after the first stage of reduction is loaded onto this layer, then 2-6 mm thick layer of metallic calcium is loaded onto the layer of powder, then again a layer of powder obtained after the first stage of reduction and again a layer of metallic calcium and so on until a full load of 145,4 kg of powder and 37,8 kg of metallic calcium (taking into account the 5 kg loaded at the beginning). The final top layer consists of reducible powder. The crucible is covered with the lid and installed in the retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed in the kiln and heated to 900° C. at the rate of 4° C. per minute. Upon reaching 900° C., the holding up is made at this temperature for 4 hours. After that, the temperature in the kiln is raised up to 1000° C. at the rate of 4° C. per minute. Upon reaching the temperature of 1000° C., the holding up is made for 20 hours. After that, the retort is cooled to 30° C. at the rate of 5° C. per minute. When the temperature in the kiln reaches 30° C., the retort is removed from the kiln, depressurization is performed, and the crucible is removed from the retort.

In the subsequent stages of quenching, neutralization, grinding, washing, drying and classification, the same procedure and sequence of actions is used as in example 4.

As a result, 133.15 kg of titanium powder alloy were obtained, similar in chemical composition to Grade 5 according to ASTM B 348-09, the characteristics of the obtained titanium powder alloy are presented in Table 3.

EXAMPLE 6

Prior to the stage of manufacturing the raw elements, the same procedure and sequence of actions are used as in example 5, except for the stage of manufacturing the raw elements, as well as the second stage of reduction, which are described below.

According to the procedure described in example 1, the efficiency of the distribution of alloying additions in the crystal lattice of titanium oxide is checked after the stage of calcining the cake of oxides/hydroxides of titanium with uniformly precipitated oxides/hydroxides of alloying additives. The results of the content of Al and V in the residue differ from the results of the content of Al and V in the sample not subjected to dissolution in sulfuric acid by less than 5%, which indicates the dissolution of alloying additives in the crystal lattice of titanium oxide and a uniform distribution of alloying additives Al and V in the entire volume of titanium oxide particles (the results are shown in Table 1).

After grinding from titanium oxide powder with alloying additives dissolved in it, the raw elements are formed by extrusion, for that the carboxymethyl cellulose is added to the powder in the amount of 14% of the powder weight, the water is added in the amount of 15% of the powder weight, and the resulting mass is mixed thoroughly using the extruder and is poured to make the hollow cylindrical castings with an outer diameter of 30 mm, a wall thickness of 5 mm, and a length of 450 mm. The resulting castings are dried to constant weight at temperature of 120° C. and then calcined at temperature of 1050° C. for 4 hours. After that, the raw elements are cooled. The porosity of the raw elements obtained is 63%, the strength is 17 kg/cm$^2$.

In the further steps of the first and second stages of reduction, quenching, neutralization, grinding, washing, drying and classification, the same procedure and sequence of actions are used as in example 5. After the first stage of reduction, a visual inspection of the raw elements was carried out, which proved that they have saved their original shape and were not subjected to destruction, although they slightly increased in size due to the saturation of the pores with calcium oxide; the raw elements were located in the retort at the level at which they were originally installed, a void formed under them in the place where the metallic calcium was, filled from below with molten calcium chloride. No traces of condensation of metallic calcium or traces of calcium oxide were found on the walls and bottom of the retort, that fact indicates the absence of transfer of the reducing agent from the crucible and the most efficient use of the reducing agent for the reduction reaction of raw elements.

The powder obtained after the first stage of reduction, ground and washed and dried, is analyzed for oxygen content to calculate the amount of the reducing agent in the second stage of reduction. The results of the oxygen content in the obtained powder are presented in Table 2.

The metallic calcium in the amount of 5 kg is loaded into the crucible made of metallic titanium (material—titanium Grade 2). The metallic calcium is in the form of granules with diameter of 2 up to 6 mm. Then, 4-6 mm thick layer of powder obtained after the first stage of reduction is loaded onto this layer, then 2-6 mm thick layer of metallic calcium is loaded onto the layer of powder, then again a layer of powder obtained after the first stage of reduction and again a layer of metallic calcium and so on until a full load of 140,4 kg of powder and 22,0 kg of metallic calcium (taking into account the 5 kg loaded at the beginning). The final top layer consists of reducible powder. The crucible is covered with the lid and installed in the retort made of AISI 310S steel. The retort is sealed, evacuated to the pressure of 0.5 mm Hg, blown out with argon (argon pressure at the range of 0.11-0.2 MPa), and again evacuated to 0.5 mm Hg, again blown out with argon (argon pressure at the range of 0.11-0.2 MPa), and again evacuated to 0.5 mm Hg and blown out with argon, argon pressure at the range of 0.11-0.2 MPa and it is kept in this range during the entire further process up to the moment the crucible is removed from the retort. After that, the retort is placed in the kiln and heated to 900° C. at the rate of 4° C. per minute. Upon reaching 900° C., the holding up is made at this temperature for 4 hours. After that, the temperature in the kiln is raised up to 1000° C. at the rate of 4° C. per minute. Upon reaching the temperature of 1000° C., the holding up is made for 20 hours. After that, the retort is cooled to 30° C. at the rate of 5° C. per minute. When the temperature in the kiln reaches 30° C., the retort is removed from the kiln, depressurization is performed, and the crucible is removed from the retort.

In the subsequent stages of quenching, neutralization, grinding, washing, drying and classification, the same procedure and sequence of actions is used as in example 5.

As a result, 133.09 kg of titanium powder alloy was obtained, similar in chemical composition to Grade 23 according to ASTM B 348-09, the characteristics of the obtained titanium powder alloy are presented in Table 3.

EXAMPLE 7

Prior to the precipitation of oxides and hydroxides of alloying additives, the same procedure and sequence of actions are used as in example 6, except for the stage of precipitation of oxides and hydroxides of alloying additives, which is described below.

Washed titanium oxide/hydroxide in the amount of 200 kg in terms of $TiO_2$ is dispersed in the precipitation reactor with demineralized water, until concentration in terms of $TiO_2$ reaches 350 g/l, after that pH of the suspension is adjusted with sodium hydroxide up to 10.5 and thoroughly mixed for 30 minutes. After that, with vigorous stirring of the reaction mass, 249 liters of sodium aluminate with A1203 content of 50 g/l are fed into the precipitation reactor at a rate of 15 liters per minute and the suspension is kept for 10 minutes. After that, 147.5 1 of ammonium metavanadate solution with V205 content of 16 g/l is fed into the precipitation reactor at a rate of 30 1 per minute and the suspension is kept for 10 minutes. After that, with vigorous stirring of the reaction mass, 14 liters of sodium molybdate with $MoO_2$ content of 100 g/l are fed into the precipitation reactor at the rate of 15 liters per minute and the suspension is kept for 10 minutes. After that, 5.6 liters of the aqueous alkaline solution of sodium silicate with $SiO_2$ content of 50 g/l is fed into the precipitation reactor at the rate of 30 liters per minute and the suspension is kept for 10 minutes. After that, pH of the reaction mass is adjusted to pH=7 with 5% hydrochloric acid solution, and the suspension is kept for 1 hour. After that, pH of the reaction mass is adjusted to pH=1, using the solution of hydrochloric acid. After that, 25.4 liters of the solution of zirconium oxychloride with $ZrO_2$ content of 70 g/l are fed into the precipitation reactor at the rate of 30 liters per minute and the suspension is kept for 10 minutes. Thereafter, 2.8 1 of tin (II) chloride solution with SnO content of 600 g/l is fed into the precipitation reactor at the rate of 30 1 per minute and suspension is kept for 10 minutes. After that, pH of the reaction mass is adjusted to pH=7 with sodium hydroxide, after that the reaction mass is heated up to 50° C. As a result of the operations performed, there is the uniform precipitation of oxides and/or hydroxides of aluminum, vanadium, silicon, molybdenum, zirconium and tin throughout the entire volume of the reaction mass, which ensures their maximum distribution on the surface of particles of titanium oxides/hydroxides. After that, the resulting reaction mass is sent for filtration to filter press to remove the mother liquor and wash out of water-soluble salts. For all other stages, the same procedure is used as described in example 6.

According to the procedure described in example 1, the efficiency of the distribution of alloying additives in the crystal lattice of titanium oxide is checked after the stage of calcining the cake of titanium oxides/hydroxides with uniformly precipitated oxides/hydroxides of alloying additives in it. The results of the content of Al, V, Sn, Zr, Si, Mo in the residue differ from the results of the content of Al, V, Sn, Zr, Si, Mo in the sample not subjected to dissolution in sulfuric acid by less than 5%, which indicates the dissolution of alloying additives in the crystal lattice of titanium oxide and the uniform distribution of alloying additives of Al, V, Sn, Zr, Si, Mo throughout the volume of titanium oxide particles (the results are shown in Table 1).

At further stages, namely at the formation of raw elements, the first and second stages of reduction, quenching, neutralization, grinding, washing, drying and classification, the same procedure and sequence of actions are used as in example 6. After the first stage of reduction, a visual inspection of raw elements was carried out, which demonstrated that they retained their original shape and were not destroyed, although they slightly increased in size due to the saturation of the pores with calcium oxide, the raw elements were located in the retort at the level at which they were originally installed, under them in the place where there was metallic calcium, a void was formed, filled from below with a molten calcium chloride.

The powder obtained after the first stage of reduction, ground and washed and dried, is analyzed for oxygen content to calculate the amount of the reducing agent in the second stage of reduction. The results of the oxygen content in the obtained powder are presented in Table 2.

As a result, 131.72 kg of titanium powder alloy was obtained, similar in chemical composition to Grade 32 according to ASTM B 348-09, the characteristics of the obtained titanium powder alloy are presented in Table 3.

EXAMPLE 8

The same procedure is carried out as in example 1, except that the precipitation of oxides and hydroxides of any alloying additives to the titanium oxide/hydroxide, obtained at the hydrolysis stage and washed out of impurities, is not carried out.

As a result, 120.1 kg of titanium powder alloy was obtained, similar in chemical composition to Grade 4 according to ASTM B 348-09, the characteristics of the obtained titanium powder alloy are presented in Table 3.

EXAMPLE 9

The same procedure is carried out as in example 3, except that the precipitation of oxides and hydroxides of any alloying additives to the titanium oxide/hydroxide, obtained at the hydrolysis stage and washed out of impurities, is not carried out.

The powder obtained after the first stage of reduction, ground and washed and dried, is analyzed for oxygen content to calculate the amount of the reducing agent in the second stage of reduction. The results of the oxygen content in the obtained powder are presented in Table 2.

As a result, 120.0 kg of titanium powder alloy was obtained, similar in chemical composition to Grade 2 according to ASTM B 348-09, the characteristics of the obtained titanium powder alloy are presented in Table 3.

EXAMPLE 10

The same procedure is carried out as in example 6, except that the precipitation of oxides and hydroxides of any alloying additives to the titanium oxide/hydroxide, obtained at the hydrolysis stage and washed out of impurities, is not carried out.

The powder obtained after the first stage of reduction, ground and washed and dried, is analyzed for oxygen content to calculate the amount of the reducing agent in the second stage of reduction. The results of the oxygen content in the obtained powder are presented in Table 2.

As a result, 119.9 kg of titanium powder alloy was obtained, similar in chemical composition to Grade 1 according to ASTM B 348-09, the characteristics of the obtained titanium powder alloy are presented in Table 3.

TABLE 1

Analysis of the distribution of alloying additives in titanium oxide after the precipitation of oxides/hydroxides of alloying additives in titanium oxide/hydroxide and subsequent calcination.

| Examples | Alloying additive type | Content of alloying additives * In the sample after calcination, % | In the undissolved sediment after dissolving 50-70% in sulfuric acid, % | Difference in the content of alloying additives in the samples after dissolving 50-70% in sulfuric acid in comparison with the samples after calcination, % |
|---|---|---|---|---|
| 1 | Al | 3.56 | 3.40 | −4.59 |
| | V | 2.37 | 2.26 | −4.81 |
| 2 | Al | 3.57 | 3.41 | −4.48 |
| | V | 2.36 | 2.25 | −4.66 |
| 3 | Al | 3.58 | 3.41 | −4.75 |
| | V | 2.38 | 2.27 | −4.62 |
| 4 | Al | 3.58 | 3.42 | −4.47 |
| | V | 2.35 | 2.25 | −4.26 |
| 5 | Al | 3.54 | 3.39 | −4.24 |
| | V | 2.33 | 2.22 | −4.72 |
| 6 | Al | 3.57 | 3.40 | −4.76 |
| | V | 2.36 | 2.25 | −4.66 |
| 7 | Al | 3.00 | 2.85 | −4.88 |
| | V | 0.60 | 0.58 | −3.36 |
| | Sn | 0.60 | 0.57 | −5.03 |
| | Zr | 0.60 | 0.59 | −1.69 |
| | Si | 0.059 | 0.057 | −3.56 |
| | Mo | 0.48 | 0.47 | −1.55 |

* Determined by XRF method, lab equipment: Rigaku Supermini 200

TABLE 2

Test results of the oxygen content in titanium metal samples after the first stage of reduction (using the two-stage reduction process)

| Examples | Chemical composition of the obtained samples *, % O |
|---|---|
| 3 | 8.51 |
| 4 | 5.54 |
| 5 | 8.32 |
| 6 | 5.02 |
| 7 | 5.01 |

TABLE 2-continued

Test results of the oxygen content in titanium metal samples after the first stage of reduction (using the two-stage reduction process)

| Examples | Chemical composition of the obtained samples *, % O |
|---|---|
| 9 | 8.11 |
| 10 | 4.75 |

* Determined using ELTRA ON 900 analyzer (manufacturer: Eltra GmbH)

TABLE 3

| Examples | Chemical composition of the obtained samples, % O* | N* | H* | C** | Fe*** | Mg*** | Ca*** | Al*** | V*** | Sn*** |
|---|---|---|---|---|---|---|---|---|---|---|
| Grade 5 according to ASTM B 348-09 | max 0.20 | max 0.05 | max 0.015 | max 0.08 | max 0.40 | not regulated | not regulated | 5.5-6.75 | 3.4-4.5 | . . . |
| 1 | 0.40 | 0.021 | 0.523 | 0.019 | 0.015 | 0.002 | 0.054 | 6.032 | 4.019 | less 0.01 |
| 2 | 0.19 | 0.020 | 0.515 | 0.021 | 0.013 | 0.002 | 0.059 | 6.011 | 4.003 | less 0.01 |
| 3 | 0.18 | 0.015 | 0.487 | 0.023 | 0.014 | 0.003 | 0.057 | 6.024 | 4.023 | less 0.01 |
| Grade 23 according to ASTM B 348-09 | max 0.13 | max 0.03 | max 0.0125 | max 0.08 | max 0.25 | refer to section Other Elements | refer to section Other Elements | 5.5-6.5 | 3.4-4.5 | . . . |
| 4 | 0.12 | 0.019 | 0.451 | 0.022 | 0.012 | 0.002 | 0.035 | 6.023 | 4.020 | less 0.01 |
| 5 | 0.20 | 0.019 | 0.449 | 0.024 | 0.013 | 0.002 | 0.048 | 6.019 | 4.018 | less 0.01 |
| 6 | 0.09 | 0.017 | 0.552 | 0.022 | 0.011 | 0.002 | 0.031 | 6.022 | 4.022 | less 0.01 |

TABLE 3-continued

| | | | | | | | | | | |
|---|---|---|---|---|---|---|---|---|---|---|
| Grade 32 according to ASTM B 348-09 | max 0.11 | max 0.03 | max 0.015 | max 0.08 | max 0.25 | refer to section Other Elements | refer to section Other Elements | 4.5-5.5 | 0.6-1.4 | 0.6-1.4 |
| 7 | 0.08 | 0.016 | 0.562 | 0.021 | 0.011 | 0.002 | 0.029 | 5.012 | 1.015 | 1.015 |
| Grade 4 according to ASTM B 348-09 | max 0.40 | max 0.05 | max 0.015 | max 0.08 | max 0.50 | refer to section Other Elements | refer to section Other Elements | . . . | . . . | . . . |
| 8 | 0.37 | 0.020 | 0.530 | 0.022 | 0.013 | 0.002 | 0.055 | less 0.01 | less 0.01 | less 0.01 |
| Grade 2 according to ASTM B 348-09 | max 0.25 | max 0.03 | max 0.015 | max 0.08 | max 0.30 | refer to section Other Elements | refer to section Other Elements | . . . | . . . | . . . |
| 9 | 0.19 | 0.022 | 0.514 | 0.021 | 0.014 | 0.002 | 0.054 | less 0.01 | less 0.01 | less 0.01 |
| Grade 1 according to ASTM B 348-09 | max 0.18 | max 0.03 | max 0.015 | max 0.08 | max 0.20 | refer to section Other Elements | refer to section Other Elements | . . . | . . . | . . . |
| 10 | 0.10 | 0.021 | 0.527 | 0.020 | 0.012 | 0.002 | 0.030 | less 0.01 | less 0.01 | less 0.01 |

| | Chemical composition of the obtained samples, % | | | | | Arithmetic- |
|---|---|---|---|---|---|---|
| Examples | Zr*** | Si*** | Mo*** | Other Elements, max. Each | Other Elements, max. Total | mean particle size **** |
| Grade 5 according to ASTM B 348-09 | . . . | . . . | . . . | max 0.1 | max 0.4 | not applicable |
| 1 | less 0.01 | less 0.01 | less 0.01 | | | 29 |
| 2 | less 0.01 | less 0.01 | less 0.01 | | | 31 |
| 3 | less 0.01 | less 0.01 | less 0.01 | | | 39 |
| Grade 23 according to ASTM B 348-09 | . . . | . . . | . . . | max 0.1 | max 0.4 | not applicable |
| 4 | less 0.01 | less 0.01 | less 0.01 | | | 55 |
| 5 | less 0.01 | less 0.01 | less 0.01 | | | 52 |
| 6 | less 0.01 | less 0.01 | less 0.01 | | | 57 |
| Grade 32 according to ASTM B 348-09 | 0.6-1.5 | 0.06-0.14 | 0.6-1.2 | max 0.1 | max 0.4 | not applicable |
| 7 | 1.020 | 0.102 | 0.802 | | | 59 |
| Grade 4 according to ASTM B 348-09 | . . . | . . . | . . . | max 0.1 | max 0.4 | not applicable |
| 8 | less 0.01 | less 0.01 | less 0.01 | | | 30 |
| Grade 2 according to ASTM B 348-09 | . . . | . . . | . . . | max 0.1 | max 0.4 | not applicable |
| 9 | less 0.01 | less 0.01 | less 0.01 | | | 37 |
| Grade 1 according to ASTM B 348-09 | . . . | . . . | . . . | max 0.1 | max 0.4 | not applicable |
| 10 | less 0.01 | less 0.01 | less 0.01 | | | 55 |

*Determined using ELEMENTRAC ONH-p analyzer (manufacturer Eltra GmbH).

**Determined using ELEMENTRAC CS-i analyzer (manufacturer Eltra GmbH).

***Determined by ICP-AES method, equipment: PERKIN ELMER Optima 2100

****Determined by laser diffraction, equipment: Mastersizer 3000

The invention claimed is:

1. A method for producing alloy powders based on titanium metal including the following stages:

a) hydrolysis of an aqueous solution of titanium-containing salt with the release of a precipitate of titanium oxides and/or hydroxides to subsequently obtain primary particles of crystalline titanium oxide with a particle size distribution of 5-50 μm;

b) washing and filtration of the formed precipitate of titanium oxides and/or hydroxides;

c) precipitation of dopant oxides and/or hydroxides on the titanium oxides and/or hydroxides precipitate, by adding dopant salts to a slurry of the titanium oxides and/or hydroxides precipitate with a pH in the range of 0.5-12 to form a reaction mass, then stirring the reaction mass and adjusting the pH of the slurry to the range of 1.5-10.0 using aqueous solutions or slurries of alkaline reagents or using acidic reagents;

d) filtration of the reaction mass to separate a cake of titanium oxides and/or hydroxides precipitate with dopant oxides and/or hydroxides precipitated on it from a mother liquor and washing the cake;

e) calcination of the titanium oxides/hydroxides precipitate with precipitates of dopant oxides and/or hydroxides precipitated on it at a temperature of 400-1300° C. for 0.5-20 hours to obtain a solid solution of dopant oxides in titanium oxide;

f) milling of a powder of the solid solution of dopant oxides in titanium oxide to form a milled powder;

g) formation of feedstock elements from the milled powder of the solid solution of dopant oxides in titanium oxide with a strength of at least 10 kg per 1 $cm^2$;

h) reduction of the feedstock elements using a reducing agent at an excess pressure in an atmosphere of argon or helium, during which 15-75% of the calculated amount of the reducing agent is loaded into a crucible, on a layer of which feedstock elements are installed; the remaining 25-85% of the calculated amount of the reducing agent being loaded on the surface of the feedstock elements; after that an inert filler is loaded onto the surface of the reducing agent, the amount of an inert filler being 10-1000% of the feedstock elements weight;

i) quenching of the reaction mass comprising soaking in water for 1-48 hours;

j) neutralization of the reaction mass, during which the pH of the reaction mass is maintained at a level of more than 0.5 using an acid selected from the group consisting of acetic acid, hydrochloric acid, and nitric acid;

k) milling of the reaction mass to form a titanium metal slurry, during which the pH of the reaction mass is maintained in the range of 0.5-7 and when the pH rises above said range, an acid selected from the group consisting of acetic acid, hydrochloric acid, and nitric acid is introduced into the reaction mass;

l) washing the titanium metal slurry to remove formed reaction products, inert filler, and residues of unreacted reducing agent, and filtration until specific electrical conductivity of 10% slurry of titanium metal in water is less than 100 μS/cm;

m) drying of a powder resulting from Stage 1) and a classification of a finished product in an atmosphere of an inert gas selected from the group consisting of argon, helium, and nitrogen having a dew point of less than −20° C. and a temperature less than 80° C.

2. The method according to claim 1, wherein the aqueous solution of Stage a) comprises an aqueous solution of titanium oxychloride ($TiOCl_2$).

3. The method according to claim 1, wherein the aqueous solution of Stage a) comprises an aqueous solution of titanium oxysulfates or titanium nitrates.

4. The method according to claim 1, comprising adjusting the pH of the slurry during Stage c) using an acidic reagent selected from the group consisting of hydrochloric, sulfuric, or nitric acids or mixtures thereof and/or alkaline agents selected from the group consisting of ammonium hydroxide, sodium hydroxide, potassium hydroxide, lithium hydroxide, calcium hydroxide, magnesium hydroxide, ammonium carbonate, sodium carbonate, potassium carbonate, lithium carbonate, calcium carbonate, and magnesium carbonate.

5. The method according to claim 1, wherein the dopant of Stage c) is selected from, Al, V, Pd, Ru, Ni, Mo, Cr, Co, Zr, Nb, Sn, Si, W, Ta, and Fe, and the salts introduced at this stage are water-soluble salts of the said dopant selected from the group consisting of chlorides, chlorates, sulfates, sulfites, nitrates, nitrites, bromides, bromates, iodides, iodates, acetates, citrates, oxalates, propionates, stearates, gluconates, and sulfonates.

6. The method according to claim 1, wherein during Stage g) formation of feedstock elements takes place, the feedstock elements being shaped as hollow cylinders with round or oval cross section, or as tubes with triangular, rectangular, square, hexagonal, or honeycombed cross section.

7. The method according to claim 6, wherein during Stage g) feedstock elements are formed with a length of 1-800 mm, and a wall thickness of 1-25 mm.

8. The method according to claim 7, wherein the feedstock elements have a wall thickness of 1-8 mm and a wall porosity of 20-70 vol. %, or a wall thickness of 9-25 mm and a wall porosity of 55-85 vol. %.

9. The method according to claim 1, wherein during Stage h) calcium metal is used as a reducing agent.

10. The method according to claim 9, wherein calcium metal is used, comprising granules with a size of 0.1-30 mm or lumps 30-500 mm in size or sheets with a thickness of 1 to 100 mm, a width of 30 to 1500 mm and a length of 30 to 1500 mm.

11. The method according to claim 1, wherein feedstock elements at Stage h) contain through holes and are installed so that the through holes in them are directed vertically.

12. The method according to claim 1, wherein the inert filler of Stage h) comprises metal halides of Groups 1-2 of the Periodic Table or their mixtures.

13. The method according to claim 1, wherein Stage h) comprises heating a furnace including a retort with the crucible placed in it at 1-6° C./min.

14. The method according to claim 13, wherein Stage h) comprises heating the retort to a temperature of 850-950° C., stopping heating, a first holding performed for 0.5-8 hours, after the first holding time is over raising the temperature at a rate 1-6° C./min to 960-1100° C. and at this temperature a second holding is carried out for 1-48 hours, and after reduction is completed, cooling the retort to a temperature of 20-300° C. at a rate of 1-5° C./min.

15. The method according to claim 1, wherein the reaction mass milling at Stage k) is carried out in a ball mill with a milling chamber being made of titanium and 25-85% filled with milling media.

16. The method according to claim 1, wherein the final moisture content of the powder after drying at Stage m) does not exceed 0.2%.

17. A method for producing alloy powders based on titanium metal including the following stages:

a) hydrolysis of an aqueous solution of titanium-containing salt with the release of a precipitate of titanium oxides and/or hydroxides to subsequently obtain primary particles of crystalline titanium oxide with a particle size distribution of 5-50 μm;

b) washing and filtration of the formed precipitate of titanium oxides and/or hydroxides;

c) precipitation of dopant oxides and/or hydroxides on the titanium oxides and/or hydroxides precipitate, by adding dopant salts to a slurry of the titanium oxides and/or hydroxides precipitate with a pH in the range of 0.5-12 to form a reaction mass, then stirring the reaction mass and adjusting the pH of the slurry to the range of 1.5-10.0 using aqueous solutions or slurries of alkaline reagents or using acidic reagents;

d) filtration of the reaction mass to separate a cake of titanium oxides and/or hydroxides precipitate with dopant oxides and/or hydroxides precipitated on it from a mother liquor and washing the cake;

e) calcination of the titanium oxides/hydroxides precipitate with precipitates of dopant oxides and/or hydroxides precipitated on it at a temperature of 400-1300° C. for 0.5-20 hours to obtain a solid solution of dopant oxides in titanium oxide;

f) milling of a powder of the solid solution of dopant oxides in titanium oxide to form a milled powder;

g) formation of feedstock elements from the milled powder of the solid solution of dopant oxides in titanium oxide with a strength of at least 10 kg per 1 $cm^2$ regardless of which side the load is applied to the feedstock element;

h) reduction of the feedstock elements using a reducing agent, during which 15-75% of the calculated amount of the reducing agent is loaded into a crucible, on a layer of which feedstock elements are installed; the remaining 25-85% of the calculated amount of the reducing agent being loaded on the surface of the feedstock elements; after that an inert filler is loaded onto the surface of the reducing agent, the amount of an inert filler being 10-1000% of the feedstock elements weight;

i) quenching of the reaction mass comprising soaking in water for 1-48 hours;

j) neutralization of the reaction mass, during which the pH of the reaction mass is maintained at a level of more than 0.5, using an acid selected from the group consisting of acetic acid, hydrochloric acid, and nitric acid;

k) milling of the reaction mass to form a titanium metal slurry, during which the pH of the reaction mass is maintained in the range of 0.5-7 and when the pH rises above said range, an acid selected from the group consisting of acetic acid, hydrochloric acid, and nitric acid is introduced into the reaction mass;

l) washing the titanium metal slurry to remove formed reaction products, inert filler, and residues of unreacted reducing agent, and filtration until specific electrical conductivity of 10% slurry of titanium metal in water is less than 100 μS/cm;

m) drying of the powder resulting from Stage 1);

n) reduction of the powder obtained at Stage m), using a reducing agent, during which a layer of the reducing agent is placed on the bottom of the crucible, and then a layer of the powder to be reduced is placed on it, so that the mass ratio of the thickness of the reducing agent layer covering the bottom of the crucible to the powder to be reduced is in the range from 1:35 to 2:1, covering the layer of the powder to be reduced again by a new layer of the reducing agent, and repeating this procedure until the crucible is fully loaded from top to bottom;

o) quenching of the reaction mass comprising soaking in water for 1-48 hours;

p) neutralization of the reaction mass, during which the pH of the reaction mass is maintained at a level of more than 0.5, using an acid selected from the group consisting of acetic acid, hydrochloric acid, and nitric acid;

q) milling of the reaction mass, during which the pH of the reaction mass is maintained in the range of 0.5-7 and when the pH rises above said range, one of acetic acid, hydrochloric acid, and nitric acid is introduced into the reaction mass;

r) washing the titanium metal slurry to remove formed reaction products, inert filler, and residues of unreacted reducing agent, and filtration until specific electrical conductivity of 10% slurry of titanium metal in water is less than 100 μS/cm;

s) drying of a powder resulting from Stage r) and a classification of a finished product in an atmosphere of an inert gas selected from the group consisting of argon, helium, and nitrogen having a dew point of less than −20° C. and a temperature less than 80° C.

18. The method according to claim 17, wherein the aqueous solution of Stage a) comprises an aqueous solution of titanium oxychloride ($TiOCl_2$).

19. The method according to claim 17, wherein the aqueous solution of Stage a) comprises an aqueous solutions of titanium oxysulfates or titanium nitrates.

20. The method according to claim 17 comprising adjusting the pH of the slurry during Stage c) using an acidic reagent selected from the group consisting of hydrochloric, sulfuric, or nitric acids or mixtures thereof and/or alkaline agents selected from the group consisting of ammonium hydroxide, sodium hydroxide, potassium hydroxide, lithium hydroxide, calcium hydroxide, magnesium hydroxide, ammonium carbonate, sodium carbonate, potassium carbonate, lithium carbonate, calcium carbonate, and magnesium carbonate.

21. The method according to claim 17, wherein the dopant of Stage c) is selected from the group consisting of Al, V, Pd, Ru, Ni, Mo, Cr, Co, Zr, Nb, Sn, Si, W, Ta, and Fe, and the salts introduced at this stage are water-soluble salts of the said dopants selected from the group consisting of chlorides, chlorates, sulfates, sulfites, nitrates, nitrites, bromides, bromates, iodides, iodates, acetates, citrates, oxalates, propionates, stearates, gluconates, and sulfonates.

22. The method according to claim 17, wherein during Stage g) formation of feedstock elements takes place, the feedstock elements being shaped as hollow cylinders with round or oval cross section, or tubes with triangular, rectangular, square, hexagonal, or honeycombed cross section.

23. The method according to claim 22, wherein during Stage g) feedstock elements are formed with a length of 1-800 mm, and wall thickness of 1 25 mm.

24. The method according to claim 23, wherein the feedstock elements have a wall thickness of 1-8 mm and a wall porosity of 20-70 vol. %, or a wall thickness of 9-25 mm and a wall porosity of 55-85 vol. %.

25. The method according to claim 17, wherein during Stage h) calcium metal or magnesium metal are used as a reducing agent.

26. The method according to claim 25, wherein calcium metal is used, comprising granules with a size of 0.1-30 mm, or lumps of 30-500 mm in size, or sheets with a thickness of 1 to 100 mm, a width of 30 to 1500 mm and a length of 30 to 1500 mm.

27. The method according to claim 25, wherein magnesium metal is used, comprising granules with a size of 0.1-30 mm, or lumps of 30-500 mm in size, or sheets with a thickness of 1 to 100 mm, a width of 30 to 1500 mm and a length of 30 to 1500 mm.

28. The method according to claim 25, wherein Stage h) comprises heating a furnace including a retort with the crucible placed in it at 1-6° C./min.

29. The method according to claim 28, wherein Stage h) comprises heating the retort to a temperature of 850-950° C., stopping heating, a first holding for 0.5-8 hours, after the first holding time is over raising the furnace temperature to 960-1100° C. and at this temperature carrying out a second holding for 1-48 hours, and after reduction is completed cooling the retort to a temperature of 20-300° C. at a rate of 1-5° C./min.

30. The method according to claim 28, wherein Stage h) comprises heating the retort to a temperature of 650-800° C., stopping heating, a first holding for 0.5-8 hours after the first holding time is over, raising the furnace temperature to 820-1050° C. and carrying out a second holding for 1-48 hours, and after reduction is completed, cooling the retort to a temperature of 20-300° C. at a rate of 1-5° C./min.

31. The method according to claim 17, wherein feedstock elements at Stage h) contain through holes and are installed so that the through holes in them are directed vertically.

32. The method according to claim 17, wherein the inert filler of Stage h) comprises metal halides of Groups 1-2 of the Periodic Table or mixtures thereof.

33. The method according to claim 17, wherein reaction mass milling at Stages k) and q) is carried out in a ball mill with a milling chamber being made of titanium and 25-85% filled with milling media.

34. The method according to claim 17, wherein the final moisture content of the powder after drying at Stage m) does not exceed 0.2%.

35. The method according to claim 17, wherein during Stage n) calcium metal is used as a reducing agent.

36. The method according to claim 17, wherein Stage n) comprises adding an inert filler comprising metal halides of Groups 1-2 of the Periodic Table or their mixtures to the crucible.

37. The method according to claim 36, wherein the inert filler is taken in an amount of 10-1000% of the feedstock elements weight.

38. The method according to claim 36, wherein the inert filler is loaded as a top layer after the layers of the reducing agent and the powder to be reduced have been loaded.

* * * * *